US010033146B2

(12) United States Patent
Tachibana et al.

(10) Patent No.: US 10,033,146 B2
(45) Date of Patent: Jul. 24, 2018

(54) METHOD OF MANUFACTURING ELECTRICAL WIRE CONNECTING STRUCTURE

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Akira Tachibana, Tokyo (JP); Kengo Mitose, Tokyo (JP); Kyota Susai, Tokyo (JP); Takao Tateyama, Tokyo (JP); Yukihiro Kawamura, Inukami-gun (JP); Takashi Tonoike, Inukami-gun (JP); Masakazu Kozawa, Inukami-gun (JP); Takuro Yamada, Inukami-gun (JP)

(73) Assignees: FURUKAWA ELECTRIC CO., LTD., Tokyo (JP); FURUKAWA AUTOMOTIVE SYSTEMS INC., Inukami-Gun (JP)

( * ) Notice: Subject to any disclaimer, the term of this patent is extended or adjusted under 35 U.S.C. 154(b) by 163 days.

(21) Appl. No.: 15/051,943

(22) Filed: Feb. 24, 2016

(65) Prior Publication Data

US 2016/0172811 A1 Jun. 16, 2016

Related U.S. Application Data

(60) Division of application No. 14/477,571, filed on Sep. 4, 2014, now Pat. No. 9,444,212, which is a (Continued)

(30) Foreign Application Priority Data

Feb. 24, 2013 (JP) ..... 2013-034049
Feb. 24, 2013 (JP) ..... 2013-034051

(51) Int. Cl.
*H01R 43/048* (2006.01)
*H01R 4/62* (2006.01)
(Continued)

(52) U.S. Cl.
CPC ..... *H01R 43/048* (2013.01); *H01R 4/183* (2013.01); *H01R 4/187* (2013.01); *H01R 4/62* (2013.01);
(Continued)

(58) Field of Classification Search
CPC ..... H01R 13/03; H01R 43/02; H01R 43/048; H01R 43/0488; H01R 4/183; H01R 4/187; H01R 4/62; Y10T 29/49183
See application file for complete search history.

(56) References Cited

U.S. PATENT DOCUMENTS 2,480,280 A 8/1949 Bergan
2,693,216 A 11/1954 Kerchner et al.
(Continued)

FOREIGN PATENT DOCUMENTS

CN 1591979 A 3/2005
CN 102185185 A 9/2011
(Continued)

OTHER PUBLICATIONS

European Office Action dated May 19, 2017, for corresponding European Application No. 14754755.8.
(Continued)

*Primary Examiner* — Minh Trinh
(74) *Attorney, Agent, or Firm* — Birch, Stewart, Kolasch & Birch, LLP

(57) ABSTRACT

A method of manufacturing an electrical wire connecting structure in which a terminal having a tube-shaped portion and a conductor portion of a covered electrical wire are crimped at the tube-shaped portion, and the tube-shaped
(Continued)

portion has a conductor crimping portion corresponding to the conductor portion, and a cover crimping portion corresponding to a cover portion of the covered electrical wire, the method comprising the steps of a) forming the tube-shaped portion, b) inserting the covered electrical wire into a corresponding space, c) crimping a welded portion of the conductor, and d) compressing the cover crimping portion.

10 Claims, 10 Drawing Sheets

Related U.S. Application Data continuation of application No. PCT/JP2014/050130, filed on Jan. 8, 2014.

(51) Int. Cl.
*H01R 13/03* (2006.01)
*H01R 4/18* (2006.01)
*H01R 43/02* (2006.01)

(52) U.S. Cl.
CPC ..... *H01R 13/03* (2013.01); *H01R 43/02* (2013.01); *H01R 43/0488* (2013.01); *Y10T 29/49183* (2015.01)

(56) References Cited

U.S. PATENT DOCUMENTS

| | | | | |
|---|---|---|---|---|
| 3,721,943 | A | 3/1973 | Curr | |
| 3,805,221 | A | 4/1974 | Kuo | |
| 4,009,927 | A | 3/1977 | Knowles | |
| 4,020,546 | A | 5/1977 | May | |
| 4,277,886 | A | 7/1981 | Bauer et al. | |
| 4,966,565 | A * | 10/1990 | Dohi | H01R 4/029 29/860 |
| 5,254,002 | A | 10/1993 | Reher et al. | |
| 5,456,005 | A | 10/1995 | Satoh et al. | |
| 7,303,450 | B2 | 12/2007 | Roset | |
| 9,444,212 | B2 * | 9/2016 | Tachibana | H01R 4/62 |
| 2004/0137801 | A1 * | 7/2004 | Quillet | H01R 4/183 439/877 |
| 2004/0168315 | A1 | 9/2004 | Onuma | |
| 2005/0026515 | A1 | 2/2005 | Hashimoto et al. | |
| 2007/0184715 | A1 | 8/2007 | Onuma | |
| 2011/0045713 | A1 | 2/2011 | Ono et al. | |
| 2011/0177727 | A1 | 7/2011 | Zhao | |
| 2013/0025935 | A1 | 1/2013 | Takayama et al. | |
| 2015/0064991 | A1 * | 3/2015 | Kawamura | H01R 4/183 439/879 |
| 2015/0079857 | A1 * | 3/2015 | Kawamura | H01R 43/0482 439/877 |
| 2016/0172811 | A1 * | 6/2016 | Tachibana | H01R 4/62 29/863 |

FOREIGN PATENT DOCUMENTS

| | | | |
|---|---|---|---|
| DE | 103 60 614 | A1 | 7/2004 |
| FR | 2 936 373 | A1 | 3/2010 |
| JP | 2-103876 | A | 4/1990 |
| JP | 6-84547 | A | 3/1994 |
| JP | 3019822 | U | 1/1996 |
| JP | 2003-173854 | A | 6/2003 |
| JP | 2004-71437 | A | 3/2004 |
| JP | 2005-174896 | A | 6/2005 |
| JP | 2010-10013 | A | 1/2010 |
| JP | 2011-222311 | A | 11/2011 |

OTHER PUBLICATIONS

Extended European Search Report, dated Jul. 13, 2016, for European Application No. 14754755.8.
Office Action dated Apr. 4, 2016, issued in corresponding European Patent Application No. 14754755.8.
Chinese Office Action dated Jun. 23, 2015, issued in corresponding Chinese Patent Application No. 201480001486.9.
International Search Report issued in PCT/JP2014/050130, dated Mar. 25, 2014.
Office Action issued in JP 2014-512201, dated Jul. 29, 2014.
Office Action issued in JP 2014-512201, dated May 27, 2014.
Written Opinion of the International Searching Authority issued in PCT/JP2014/050130, dated Mar. 25, 2014.
Final Office Action dated Sep. 4, 2015, issued in U.S. Appl. No. 14/477,571.
International Preliminary Report on Patentability (with English Translation) dated Sep. 3, 2015, issued in International Application No. PCT/JP2014/050130.
Notice of Allowability dated Nov. 24, 2015, issued in U.S. Appl. No. 14/477,571.
Office Action dated Apr. 21, 2015, issued in U.S. Appl. No. 14/477,571.
Office Action dated Sep. 4, 2015, issued in U.S. Appl. No. 14/477,571.
Restriction Requirement dated Feb. 12, 2015, issued in U.S. Appl. No. 14/477,571.
Chinese Office Action for Chinese Application No. 201480001486.9, dated Mar. 3, 2016, with an English translation.
English machine translation of Japanese Publication No. 2003-173854-A, published Jun. 20, 2003.
English machine translation of Japanese Publication No. 2004-71437-A, published Mar. 4, 2004.
English machine translation of Japanese Publication No. 3019822-U, published Jan. 12, 1996.
English translation of Chinese Office Action for Chinese Application No. 201480001486.9, dated Jun. 23, 2015.
English translation of the Japanese Office Action for Japanese Application No. 2014-512201, dated Jul. 29, 2014.
English translation of the Japanese Office Action for Japanese Application No. 2014-512201, dated May 27, 2014.

* cited by examiner

METHOD OF MANUFACTURING ELECTRICAL WIRE CONNECTING STRUCTURE

This application is a Divisional of application Ser. No. 14/477,571, now U.S. Pat. No. 9,444,212, filed Sep. 4, 2014, which is a Continuation of PCT International Application No. PCT/JP2014/050130, filed Jan. 8, 2014, which claims priority under 35 U.S.C. 119(a) to Japanese Patent Application No. 2013-034049 filed in Japan on Feb. 24, 2013 and to Japanese Patent Application No. 2013-034051 filed in Japan on Feb. 24, 2013, all of which are hereby expressly incorporated by reference into the present application.

TECHNICAL FIELD

The present invention relates to a part serving to perform electrical conduction, and more specifically to a method of manufacturing an electrical wire connecting structure for an electrical wire and a terminal, and an electrical wire connecting structure.

BACKGROUND ART

A wire harness (a bundle of electrical wires) comprising a bundle of plural electrical wires is routed in a vehicle or the like, and plural electrical components are electrically connected to one another through the wire harness. The connection between a wire harness and an electrical component or the connection between wire harnesses is performed through connectors which are respectively provided to these parts. A covered electrical wire which is formed by covering a core wire portion (conductive portion) with an insulating material is used as this type of electrical wire. For example, a terminal is connected to an end portion of the core wire which is exposed by exfoliating a covering material from the covered electrical wire, and a connector is mounted through the terminal.

Here, electrical wires which are different in size are used for a vehicle or the like. Therefore, when different types of crimp terminals are prepared in accordance with different sizes, the types of the crimp terminals increase, so that the manufacturing process of terminals and the management of terminals under crimping work are cumbersome.

When there is no crimp terminal adaptable to an extra-fine electrical wire, it has been hitherto proposed that a shield wire is used as a dummy conductor and swaged together with a core wire portion by a crimp terminal (see JP-A-H06-084547 (Patent Document 1), for example). It has been also proposed to enlarge the application range of the outer diameter of electrical wires by improving the shape of a crimper (see JP-A-2003-173854 (Patent Document 2), for example) and to reduce the outer diameter of a core wire portion through an ultrasonic treatment and perform crimp connection to a crimp terminal (see JP-A-2011-222311 (Patent Document 3), for example).

Means of Solving the Problem

The technique described in the Patent Document 1 requires a cutting treatment for electrically insulating the core wire portion and the shield wire after the core wire portion and the shield wire are swaged in a lump. Therefore, this process is not a general work and the work itself is cumbersome.

Furthermore, the technique described in the Patent Document 2 requires improvement of a crimper, the shape of the crimper is complicated and the crimping work is also complicated. In addition, since an open barrel terminal is used, adhesion of water to the core wire portion is unavoidable when water exists around the core wire portion. Still furthermore, the technique described in the Patent Document 3 requires equipment for the ultrasonic treatment, which causes increase of the number of working steps.

Therefore, the present invention has an object to reduce the types of crimp terminals and provide a method of manufacturing an electrical wire connecting structure that can easily secure electrical wire holding force and an electrical wire connecting structure.

In order to attain the above object, according to the present invention, a method of manufacturing an electrical wire connecting structure in which a terminal having a tube-shaped portion and a conductor portion of a covered electrical wire are crimp-connected to each other, is characterized by comprising the steps of: preparing a terminal having a tube-shaped portion of 1.5 to 2.0 mm in inner diameter for a covered electrical wire in which the area of a conductor portion in cross-section vertical to a longitudinal direction of the covered electrical wire ranges from 0.72 to 1.37 $mm^2$; inserting the covered electrical wire into an electrical wire insertion port of the tube-shaped portion; and compressing the tube-shaped portion and the conductor portion of the covered electrical wire to crimp-connect the tube-shaped portion and the conductor portion.

According to the present invention, a method of manufacturing an electrical wire connecting structure in which a terminal having a tube-shaped portion and a conductor portion of a covered electrical wire are crimp-connected to each other, is characterized by comprising the steps of: preparing a terminal having a tube-shaped portion of 2.2 to 3.0 mm in inner diameter for a covered electrical wire in which the area of a conductor portion in cross-section vertical to a longitudinal direction of the covered electrical wire ranges from 1.22 to 2.65 $mm^2$; inserting the covered electrical wire into an electrical wire insertion port of the tube-shaped portion; and compressing the tube-shaped portion and the conductor portion of the covered electrical wire to crimp-connect the tube-shaped portion and the conductor portion.

According to the present invention, an end portion at the opposite side to the electrical wire insertion port of the tube-shaped portion is closed, and a closed cylindrical body that is closed from the end portion at the opposite side to the electrical wire insertion port except for the electrical wire insertion port is formed.

According to the present invention, the closed cylindrical body is formed by press working and laser welding. The tube-shaped portion is formed as a stepped tube having plural tube aperture diameters.

According to the present invention, the tube-shaped portion is configured so as to have a larger tube aperture diameter as approaching to the electrical wire insertion port. The plural aperture diameters are provided in accordance with the thickness of a cover portion of the covered electrical wire.

According to the present invention, an electrical wire connecting structure in which a terminal having a tube-shaped portion and a conductor portion of a covered electrical wire are crimp-connected to each other, is characterized in that the terminal having the tube-shaped portion of 1.5 to 2.0 mm in inner diameter are crimp-connected to the conductor portion of the covered electrical wire in which the area of the conductor portion in cross-section vertical to a longitudinal direction of the covered electrical wire ranges from 0.72 to 1.37 $mm^2$.

According to the present invention, an electrical wire connecting structure in which a terminal having a tube-shaped portion and a conductor portion of a covered electrical wire are crimp-connected to each other, is characterized in that the terminal having the tube-shaped portion of 2.2 to 3.0 mm in inner diameter is crimp-connected to the conductor portion of the covered electrical wire in which the area of a conductor portion in cross-section vertical to a longitudinal direction of the covered electrical wire ranges from 1.22 to 2.65 $mm^2$.

According to the present invention, the tube-shaped portion of the terminal is formed as a stepped tube having plural tube aperture diameters each of which corresponds to the diameter of the cover portion of the covered electrical wire.

According to the present invention, the stepped tube is closed at an end portion opposite to an opening portion in which the covered electrical wire is inserted, formed to have a closed cylindrical body that extends cylindrically and continuously from the end portion to the opening portion with being closed except for the opening portion, and has a larger tube aperture diameter as approaching to the opening portion.

According to the present invention, the tube-shaped portion has a closed portion at an end portion opposite to an electrical wire insertion port, and is configured as a closed cylindrical body that is closed from the closed portion to the electrical wire insertion port except for the electrical wire insertion port.

According to the present invention, the tube-shaped portion comprises a stepped tube having plural tube aperture diameters. Furthermore, the tube-shaped portion is configured to have a larger tube aperture diameter as approaching to the electrical wire insertion port.

According to the present invention, the stepped tube has plural aperture diameters that are provided in accordance with the thickness of a cover portion of the covered electrical wire. The tube-shaped portion is formed of a copper or copper alloy base material.

According to the present invention, the tube-shaped portion comprises a metal member formed by laminating a layer of any one of tin, nickel, silver and gold on a copper or copper alloy base material.

According to the present invention, the conductor portion of the covered electrical wire is formed of aluminum or aluminum alloy.

In the present invention, a terminal having a tube-shaped portion of 1.5 to 2.0 mm in inner diameter is prepared for a covered electrical wire in which the area of a conductor portion in cross-section vertical to a longitudinal direction of the covered electrical wire ranges from 0.72 to 1.37 $mm^2$, the covered electrical wire is inserted into the electrical wire insertion port of the tube-shaped portion, and the tube-shaped portion and the conductor portion of the covered electrical wire are compressed to be crimp-connected to each other. Therefore, the types of the crimp-style terminals can be reduced, and the electrical wire holding force can be secured. Furthermore, a terminal having a tube-shaped portion of 2.2 to 3.0 mm in inner diameter is prepared for a covered electrical wire in which the area of a conductor portion in cross-section vertical to a longitudinal direction of the covered electrical wire ranges from 1.22 to 2.65 $mm^2$, the covered electrical wire is inserted into an electrical wire insertion port of the tube-shaped portion, and the tube-shaped portion and the conductor portion of the covered electrical wire are compressed to be crimp-connected to each other. Therefore, the types of the crimp-style terminals can be reduced, and the electrical wire holding force can be secured.

EMBODIMENTS

Embodiments according to the present invention will be described hereunder with reference to the drawings.

First Embodiment

Figure 1:
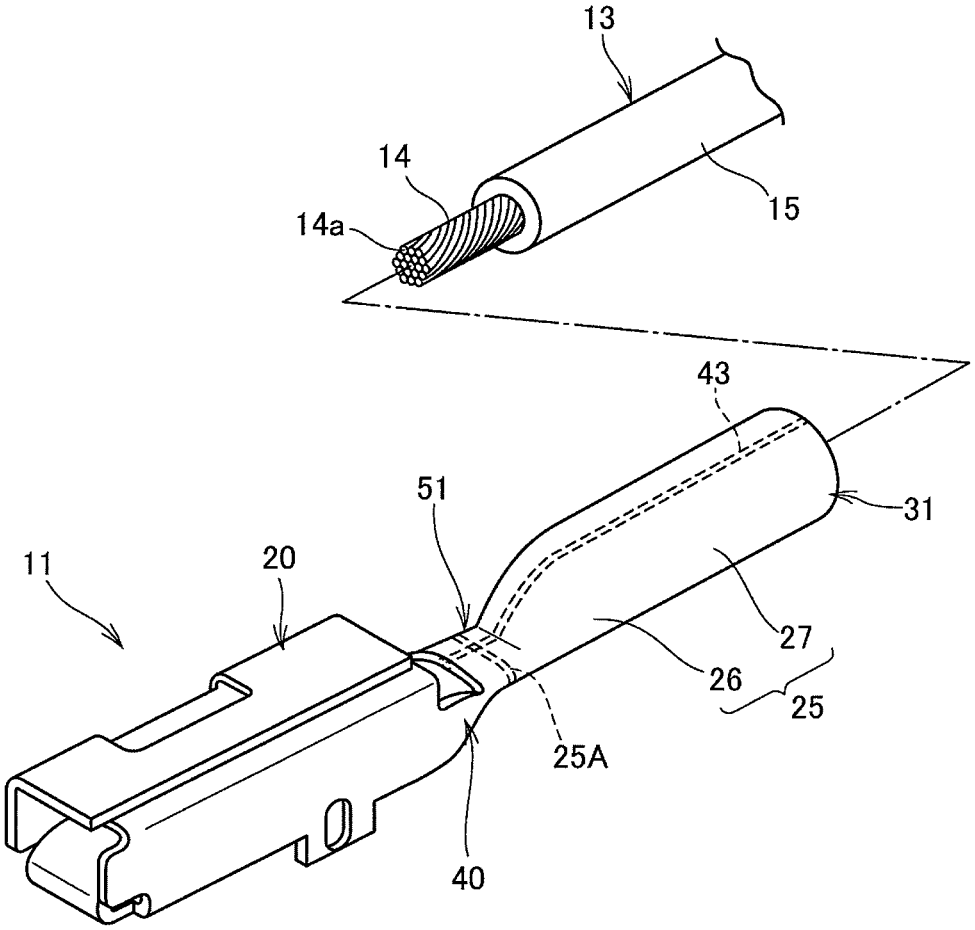
FIG. 1 is a perspective view showing a state of an electrical wire connecting structure according to a first embodiment before crimp connection.
Figure 2:
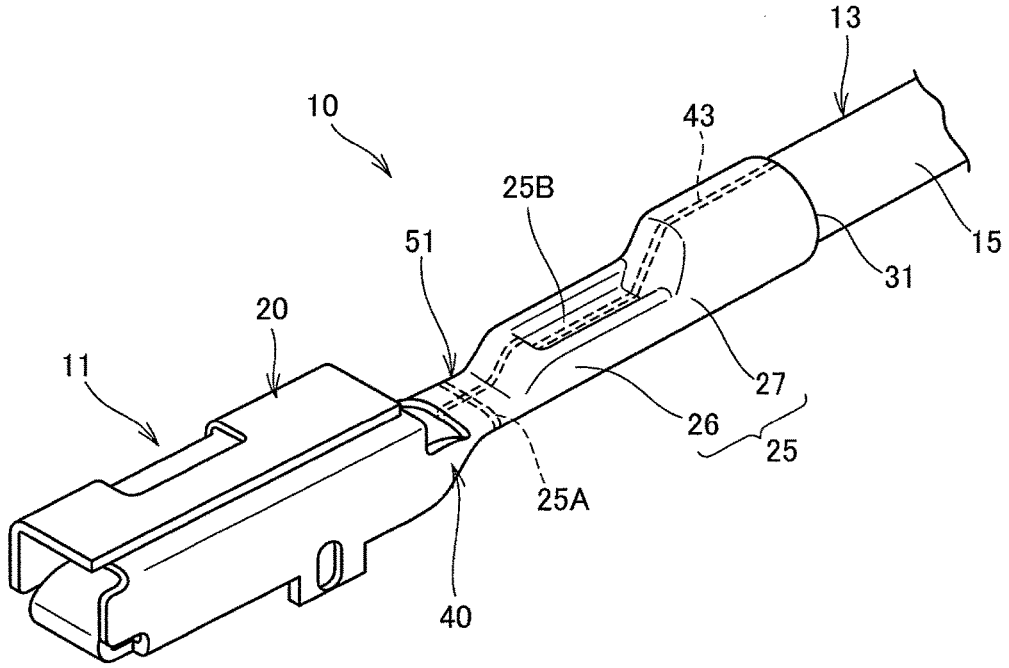
FIG. 2 is a perspective view showing the electrical wire connecting structure according to the first embodiment.
Figure 3:
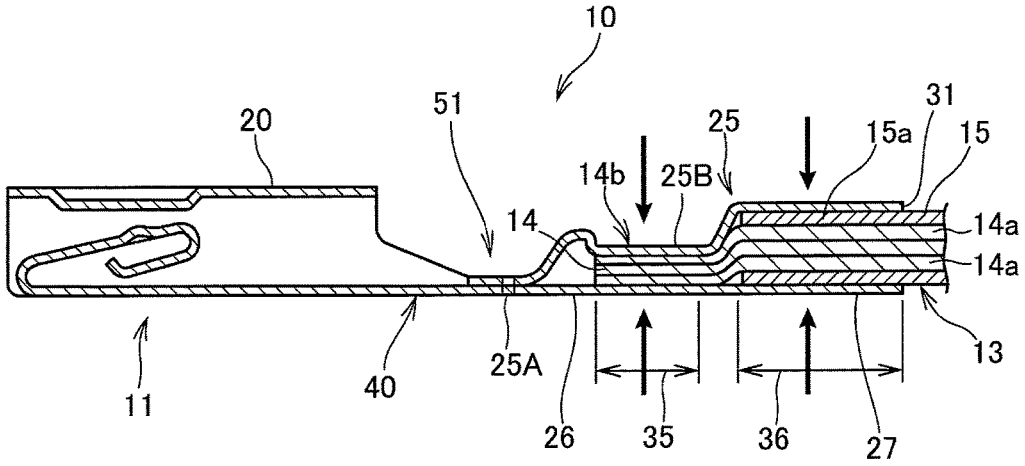
FIG. 3 is a cross-sectional view showing the electrical wire connecting structure according to the first embodiment.

FIG. 1 shows a state of an electrical wire connecting structure according to a first embodiment before crimp connection. FIG. 2 is a perspective view showing the electrical wire connecting structure according to the first embodiment, and FIG. 3 is a cross-sectional view showing the electrical wire connecting structure. The electrical wire connecting structure 10 is used for a wire harness of a vehicle, for example. The electrical wire connecting structure 10 has a terminal (tube terminal) 11, and an electrical wire (covered electrical wire) 13 which is crimp-connected (also called as "crimp-bonded") to the terminal 11.

The terminal 11 has a box portion 20 and a tube-shaped portion 25 of a female type terminal, and also a transition portion 40 serving as a bridge for the box portion 20 and the tube-shaped portion 25. The terminal 11 is basically formed of a metal (copper or copper alloy in this embodiment) base material to secure electrical conductivity and mechanical strength). For example, brass, corson-based copper alloy material or the like is used. Or, a metal member in which a layer formed of tin, nickel, silver, gold or the like is laminated on the base material may be used. The metal member is formed by subjecting the metal base material to plating or a reflow treatment. The plating or the reflow treatment is normally performed before the base material is processed into a terminal shape. However, it may be performed after the base material is processed into the terminal shape. The base material of the terminal 11 is not limited to copper or copper alloy, and aluminum, iron, alloy containing aluminum or iron as a main component or the like may be used. The terminal 11 according to this embodiment is formed by processing the wholly tin-plated metal member into the terminal shape.

The electrical wire 13 comprises a core wire portion (conductive portion) 14 and an insulating cover portion (cover portion) 15. The core wire portion 14 comprises element wires 14*a* formed of metal material bearing electrical conduction of the electrical wire 13. The element wires 14*a* are formed of copper-based material, aluminum-based material or the like. The electrical wire having the core wire portion formed of aluminum-based material (called as aluminum electrical wire, too) is lighter in weight than the electrical wire having the core wire portion formed of copper-based material, and thus it is advantageous for enhancing the fuel consumption of a vehicle or the like. The electrical wire 13 of this embodiment is constructed by covering the core wire portion 14 comprising a bundle of the element wires 14*a* of aluminum alloy with the insulating cover portion 15 formed of insulating resin of polyvinyl chloride or the like. The core wire portion 14 is constructed by twisted wires which are obtained by twisting the element wires 14*a* so as to have a predetermined cross-sectional area. The twisted wires of the core wire portion 14 may be subjected to compression processing after twisted.

When the element wires 14*a* of the electrical wire 13 are formed of aluminum alloy, aluminum alloy containing alloy elements such as iron (Fe), copper (Cu), magnesium (Mg), silicon (Si), titanium (Ti), zirconium (Zr), tin (Sn), manganese (Mn) or the like may be used as components. 6000-series aluminum alloy which is preferably applicable to wire harnesses or the like is preferable.

Resin containing polyvinyl chloride as a main component is representatively used as the resin material constituting the insulating cover portion 15 of the electrical wire 13. Halogen-based resin containing cross-linked polyvinyl chloride, chloroprene rubber or the like as a main component, or halogen free resin containing polyethylene, cross-linked polyethylene, ethylene-propylene rubber, silicone rubber, polyester or the like as a main component is used in addition to polyvinyl chloride. These resin materials may contain additive agent such as plasticizer, flame retardant or the like.

The box portion 20 of the terminal 11 is a box portion of a female type terminal which permits insertion of an insertion tab such as a male type terminal, a pin or the like. In this embodiment, the shape of the narrow portion of the box portion 20 is not limited to a specific one. That is, the terminal 11 may be configured to have at least the tube-shaped portion 25 through the transition portion 40. The terminal 11 may be provided with no box portion 20, or the box portion 20 may be an insertion tab of a male type terminal, for example. The terminal 11 may be configured so that the tube-shaped portion 25 is connected to a terminal end portion of another part. In this specification, an example in which a female type box is provided will be conveniently described to describe the terminal 11 of the embodiment.

The tube-shaped portion 25 is a site for crimping and connecting the terminal 11 and the electrical wire 13, and it is also called as a tube-shaped crimping portion. The tube-shaped portion 25 comprises a diameter-increasing portion 26 which gradually increases in diameter from the transition portion 40, and a cylindrical portion 27 extending in a cylindrical shape from the edge portion of the diameter-increasing portion 26 while keeping the diameter to the same value. The tube-shaped portion 25 is configured as a hollow tube, and an electrical wire insertion port (opening portion) 31 through which the electrical wire 13 can be inserted is formed at one end of the tube-shaped portion 25. The other end of the tube-shaped portion 25 is connected to the transition portion 40. The other end of the tube-shaped portion 25 is preferably blocked by crushing or welding for sealing so that water or the like does not infiltrate from the transition portion 40 side. In this embodiment, a weld bead portion 25A is formed after the other end of the tube-shaped portion 25 is crushed, and infiltration of water or the like from the transition portion 40 side is prevented by the weld bead portion 25A.

The tube-shaped portion 25 is formed of a plate material as a metal member having a tin layer on a copper alloy base material, for example. Or, it may be subjected to tin plating before or after the copper alloy base material is punched and subjected to bending work. The box portion 20, the transition portion 40 and the tube-shaped portion 25 may be formed from a single plate member so as to be continuous with one another. Alternatively, the box portion 20 and the tube-shaped portion 25 may be formed from the same or different plate members, and then bonded to each other at the transition portion 40.

The tube-shaped portion 25 is formed by performing a punching step of punching the base material or the plate material of the metal member like a development diagram of the terminal 11, a bending step and a connection step. In the bending step, the material is processed so that the cross-section in the vertical direction to the longitudinal direction is substantially C-shaped. In the connection step, the end faces of the opened C-shape are made to butt each other or overlapped with each other, and bonded to each other by welding, crimping or the like. The bonding to form the tube-shaped portion 25 is preferably performed by laser welding, but a welding method such as electron beam welding, ultrasonic welding, resistance welding or the like may be used. The bonding may be performed by using connection medium such as solder, wax or the like.

The electrical wire 13 is inserted into the electrical wire insertion port 31 of the tube-shaped portion 25. Accordingly, when the inner diameter of the tube-shaped portion 25 is referred to, an electrical wire 13 having a precise circle of the diameter concerned can come into contact with the tube-shaped portion 25. That is, when the inner diameter of the tube-shaped portion 25 is defined as r although the tube-shaped portion 25 has an elliptical shape, a rectangular shape or the like, it may be recognized that the electrical wire 13 having the outer diameter of r can be inserted in the tube-shaped portion 25 (but no attention is paid to a realistic problem such as friction resistance under insertion, etc.).

In this embodiment, the tube-shaped portion 25 is formed by laser welding, and a weld bead portion 43 extending in the axial direction is formed on the tube-shaped portion 25 as shown in FIG. 1. The other end of the tube-shaped portion 25 at the opposite side to the electrical wire insertion port 31 has a closed portion 51. The closed portion 51 is blocked by means such as welding, crimping or the like after press, and formed so that water, etc. do not infiltrate from the transition portion 40 side. The inner space of the tube-shaped portion 25 is closed by the closed portion 51. Accordingly, the tube-shaped portion 25 is designed to have a closed cylindrical body.

The tube-shaped portion 25 may be formed by a deep drawing method in spite of the above method of bonding both the end portions of the C-shaped cross-section. Furthermore, the tube-shaped portion 25 and the transition portion 40 may be formed by cutting a continuous tube and closing one end side thereof. The tube-shaped portion 25 is not necessarily designed to have a cylindrical shape extending in the longitudinal direction insofar as it is tube-shaped. The tube-shaped portion 25 may be a tube which is elliptical or rectangular in cross-section. Furthermore, the diameter thereof is not necessarily constant, but it may be shaped so that the radius thereof in the longitudinal direction varies.

As not shown, the inside of the tube-shaped portion 25 may be provided with a hook groove(s) (serration) such as a groove(s), a projection(s) or the like so as to establish electrical connection with the electrical wire 13 and/or make the electrical wire hard to fall out.

The tube-shaped portion 25 and the electrical wire 13 are crimp-connected to each other by inserting the electrical wire 13 in the electrical wire insertion port 31 of the tube-shaped portion 25 and compressing the end portion of the tube-shaped portion 25 at the opposite side to the electrical wire insertion port 31 (see FIGS. 2 and 3). Under the compression, the area of the tube-shaped portion 25 which corresponds to the core wire portion 14 of the electrical wire 13 is strongly compressed, and a crimping mark 25 which is concaved to the core wire portion 14 is formed there (see FIGS. 2 and 3). In FIG. 3, crimping places are represented by arrows.

Figure 4:
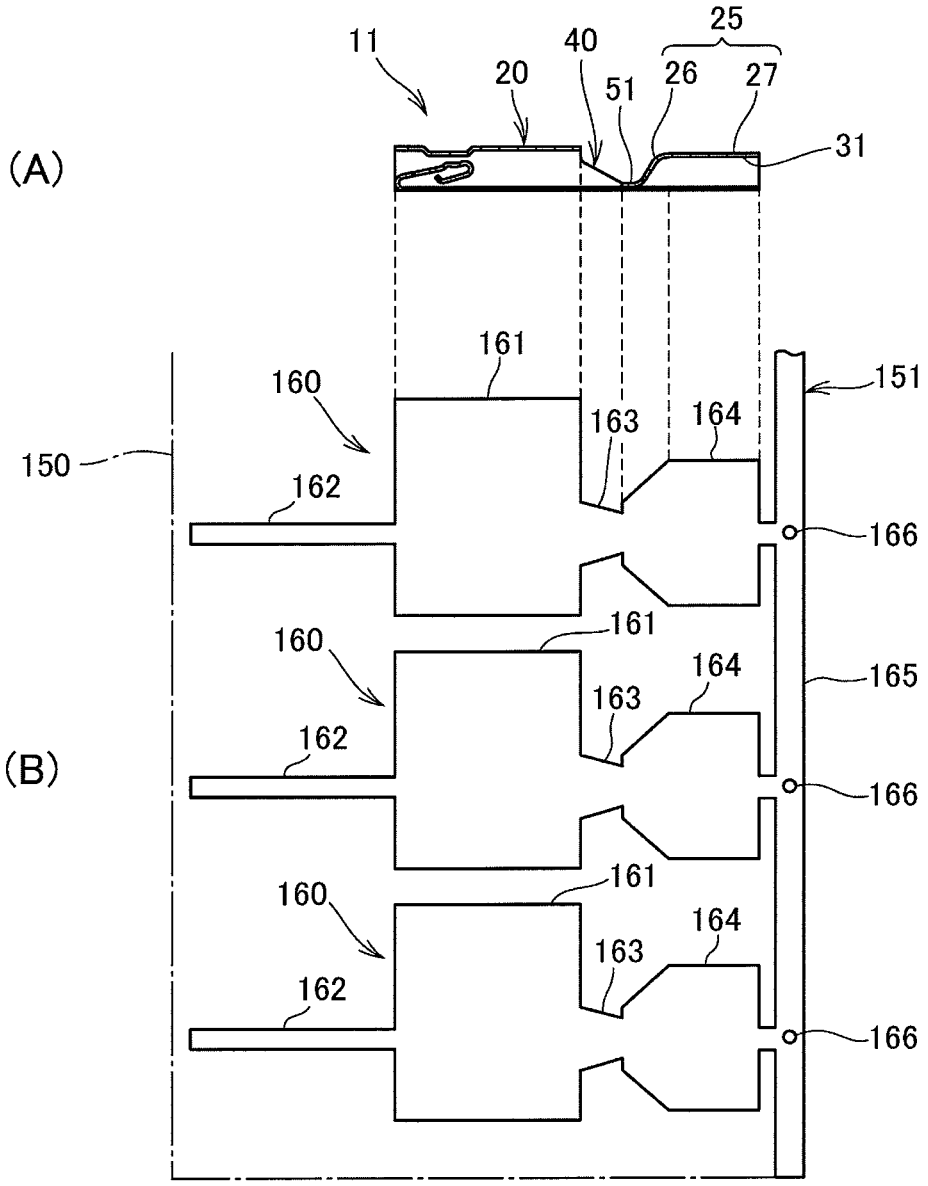
FIG. 4 shows a terminal, wherein (A) is a cross-sectional view of the terminal and (B) shows chained terminals just after punching.

FIGS. 4(A) and 4(B) are diagrams showing a specific example of a method of manufacturing the terminal 11. FIG. 4(A) is a cross-sectional view of the terminal 11, and FIG. 4(B) shows a chained terminal (punched material) 151 just after the base material or the metal member is punched. The correspondence relation between the terminal 11 and each part of the chained terminals 151 is represented by broken lines. The shape of the base material or the plate member of the metal member before punching is represented by a one-dotted chain line.

The method of manufacturing the terminal 11 contains the punching step and the bending step, and the terminal 11 is manufactured by the punching step, the bending step, the welding step and the step of pressing one end of the tube-shaped portion 25, for example.

As shown in FIGS. 4(A) and 4(B), in the punching step, the plate member 150 is punched by the press working to form the chained terminal 151. The plate material 150 is formed of a plate material of a metal base material (copper or copper alloy in this embodiment) or a plate material of a metal member obtained by subjecting the metal base material to a treatment such as plating, surface coating or the like. The thickness of the metal base material may be set to enable the punching work, and for example it may be set to 0.2 to 0.8 mm. The thickness of the layer formed of tin, nickel, silver, gold or the like may be set to 0.2 to 2.0 μm when the layer is provided by plating. Two or more layers formed of tin, nickel, silver, gold or the like may be provided. The chained terminal 151 punched from the plate material 150 is shaped so that plural terminal forming pieces 160 each serving as one terminal 11 are arranged and the respective terminal forming pieces 160 are joined to one another through a joint portion 165. The chained terminal 151 is a punched material obtained by punching the plate material 150, and thus it is a flat plate. Furthermore, when the chained terminal 151 is punched out from the plate material 150, positioning holes (pilot holes) 166 representing the positions of the respective terminal forming pieces 160 are perforated at any positions of the joint portion 165.

The terminal forming piece 160 has a box forming portion 161 which is formed into the box portion 20 by the bending work, and a spring forming portion 162 which is joined to the box forming portion 161 and formed into a spring (spring contact point) in the box portion 20 by the bending work. Furthermore, the box forming portion 161 is connected to a transition forming portion 163 which is formed into the transition portion 40 by the bending work based on press. Furthermore, the other end of the transition forming portion 163 is connected to a tube forming portion 164 which is formed into the tube-shaped portion 25 by the bending work based on press. In the bending step, a work of substantially vertically folding the box forming portion 161 at plural times to form the box portion 20, and a work of folding the spring forming portion 162 to accommodate the spring forming portion 162 in the box portion 20 are performed in parallel to each other, and further a work for rolling up the tube forming portion 164 is performed.

The tube forming portion 164 is first bent from the vertical direction to the plane of the joint portion 165 so as to be U-shaped in section by press working. Thereafter, the tube forming portion 164 is shaped to be C-shaped in section by the work of rolling up the tip end sides of the U-shape. Subsequently, the end faces of the C-shape are welded or crimp-connected to each other. The end portion of the tube-shaped portion 31 which is at the opposite side to the electrical wire insertion port 31 is crushed for internal sealing, thereby forming a blocked tube-shaped body. The bending work for the box forming portion 161 and the spring forming portion 162 and the work for the transition forming portion 163 and the tube forming portion 164 may be executed individually or in parallel to each other. The bending work may be simultaneously executed on the plural terminal forming pieces 160 which are joined to one another through the joint portion 165. After the tube-shaped portion 25 is formed by the bending work and the welding or the like, the tube-shaped portion 25 is cut out from the joint portion 165 in a cut-out step to form the terminal 11. In this case, the tube-shaped portion 25 may be cut out from the joint portion 165 simultaneously with the crimp-connection step of the electrical wire 13 in accordance with the manufacturing process of the electrical wire connecting structure 10. Alternatively, the tube-shaped portion 25 may be cut out from the joint portion 165 after the crimp-connection step of the electrical wire 13.

A method of manufacturing the electrical wire connecting structure 10 will be described. The method of manufacturing the electrical wire connecting structure 10 comprises a step of inserting an electrical wire and a crimp-connection step. In the electrical wire inserting step, the insulating cover portion 15 at the terminal of an electrical wire 13 is exfoliated to expose the core wire portion 14. This electrical wire 13 is inserted from the electrical wire insertion port 31 of the tube-shaped portion 25 till the cover tip portion 15*a*. In the crimp-connection step, the tube-shaped portion 25 and the core wire portion 14 are crimp-connected to each other by compressing the tube-shaped portion 25. It is preferable to compress the tube-shaped portion 25 so that the inner surface of the tube-shaped portion 25 and the insulating cover portion 15 are brought into close contact with each other with no gap therebetween.

In the tube-shaped portion 25, the metal base material or metal member constituting the tube-shaped portion 25 and the electrical wire 13 are compressed from the outside to be mechanically and electrically connected to each other. The tube-shaped portion 25 is plastically deformed by crimping in the crimping step. As shown in FIG. 3, there are formed a conductor crimping portion 35 under the state that the tube-shaped portion 25 and the core wire portion 14 are crimp-connected to each other, and a cover crimping portion 36 under the state that the tube-shaped portion 25 and the insulating cover portion 15 are crimp-connected to each other. The connection between the tube-shaped portion 25 and the core wire portion 14 serves as electrical connection, and thus they are particularly subjected to high deformation. Accordingly, a part of the tube-shaped portion 25 is shaped as if it is strongly pressed at a part of the conductor crimping portion 35. The mechanical and electrical connection between the terminal 11 and the electrical wire 13 can be secured through the crimping step as described above.

When the tube-shaped portion 25 and the electrical wire 13 are crimped to each other, the conductor crimping portion 35 and the cover crimping portion 36 are partially strongly compressed and plastically deformed by using a crimping instrument (a jig such as a clamper 101 and an anvil 103 or the like). In the example shown in FIG. 3, the conductor crimping portion 35 corresponds to a site at which the contraction rate (compressibility) is highest.

A function of maintaining conductivity by strongly compressing the core wire portion 14 and a function of maintaining sealing performance (water shutoff performance) by compressing the insulating cover portion 15 (the cover tip portion 15*a*) are required to the tube-shaped portion 25. Furthermore, it is preferable in the cover crimping portion 36 that the cross-section thereof is swaged in a substantially true circular shape and uniform elastic repulsive force occurs over the whole periphery of the insulating cover portion 15 by applying substantially the same pressure to the whole periphery of the insulating cover portion 15, thereby obtaining the sealing performance. The actual crimping step adopts the following method. The tip portion 14*b* of the core wire portion from which the insulating cover portion 15 is exfoliated by a predetermined length is inserted into the terminal 11 having the conductor crimping portion 35 and the cover crimping portion 36 which is set on the anvil 103 described later, and the clamper 101 is descended from the upper side to apply pressure, whereby the conductor crimping portion 35 and the cover crimping portion 36 are crimped (swaged).

In this construction, the tube-shaped portion 25 is designed like a tube having a bottom which is closed at one end thereof and opened at the other end thereof, so that infiltration of water or the like from one end side thereof can be suppressed. On the other hand, when a gap exists between the terminal 11 and the power electrical wire 13 at the other end side of the tube-shaped portion 25, there is a risk that water infiltrates from the gap and adheres to the core wire portion 14. When water or the like adheres to the joint portion between the core wire portion 14 and the metal base material (copper or copper alloy) or metal member (the material having the tin layer on the base material) of the terminal 11, there occurs a phenomenon that any one of both the metal materials corrodes due to the difference in electromotive force between both the metal materials (ionization tendency) (that is, electrical corrosion), which causes a problem that the lifetime of products is shortened. This problem becomes remarkable particularly when the base material of the tube-shaped portion 25 is copper-based material and the core wire portion 14 is aluminum-based material. However, in order to avoid this problem, when tube-shaped portions 25 having different inner diameters are prepared in accordance with different outer diameters of electrical wires 13 to manufacture terminals 11, the types of the tube-shaped portions 25 increase, and the management of parts, etc. are cumbersome.

Therefore, the inventors of this application has considered a method of preparing tube-shaped portions 25 having the same tube inner diameter for plural types of electrical wires 13 having plural outer diameters defined by conductor cross-sectional areas, inserting the electrical wire 13 having any outer diameter into the tube-shaped portion 25 having the same tube inner diameter and crimp-connecting the electrical wire 13 and the tube-shaped portion 25 by substantially the same work as a general crimping method. When the plural types of electrical wires 13 are crimp-connected to the tube-shaped portions 25 having the same tube inner diameter as described above, the types of the terminals 11 used for the electrical wires 13 can be reduced, and the management of the terminals in the terminal manufacturing process and the crimping process can be facilitated.

In this case, the insulating cover portion 15 (the cover tip portion 15*a*) is compressed by the compression deformation of the tube-shaped portion 25 to the extent that the insulating cover portion 15 is not destructed, whereby the tube-shaped portion 25 and the insulating cover portion 15 can be brought into close contact with each other and the cutoff performance and the holding force of the electrical wire can be sufficiently secured. Therefore, the crimping step is executed with the force which actuates the compression force with which at least the insulating cover portion 15 (cover tip portion 15*a*) as the cover layer of the electrical wire 13 is brought into close contact with the tube-shaped portion 25 with no gap therebetween.

In the crimping step, the crimp height (the height after the crimping portion is crimped) and the crimp wide (the width after the crimping portion is crimped) of the tube-shaped portion 25 (particularly, the cover crimping portion 36) are set so that the compressibility of the conductor is equal to a target value, whereby the compression can be properly performed. Here, the compressibility of the conductor as the core wire portion 14 is defined as follows. The term of "cross-sectional area" means the area of the cross-section vertical to the longitudinal direction of the electrical wire 13.

Compressibility=(the cross-sectional area of the conductor portion after compression)/(the cross-sectional area of the conductor portion before compression)

In the crimp-connection, the compressibility of the conductor crimping portion 35 is set to those values that can secure the electrical wire holding force and the contact pressure between the tube-shaped portion 25 and the core wire portion 14, whereby the electrical wire holding force and the contact pressure can be easily secured. Accordingly, the core wire holding force of the electrical wire 13 can be easily secured, and the conduction to the tube-shaped portion 25 can be easily secured. In this case, the core wire portion 14 is also compressed by the compression of the tube-shaped portion 25, whereby the tube-shaped portion 25 and the core wire portion 14 can be brought into sufficient contact with each other and the electrical wire holding force and the contact pressure can be sufficiently secured. That is, the crimping step is executed by the force which actuates the compression force for compressing at least the core wire portion 14.

In the crimping step, the crimp height (the height after the crimping portion is crimped) and the crimp wide (the width after the crimping portion is crimped) of the tube-shaped portion 25 (in this case, particularly the conductor crimping portion 35) are also set so that the compressibility of the conductor crimping portion 35 (corresponding to the conductor compressibility) is equal to a target value, whereby the compression can be properly performed. The crimping of the cover crimping portion 36 and the crimping of the conductor crimping portion 35 may be performed simultaneously with each other or individually.

With respect to the gap between the tube-shaped portion 25 and the insulating cover portion 15, adhesive agent such as rubber type or the like which can block the gap may be coated to the inside of the tube-shaped portion 25 or the outer periphery of the insulating cover portion 1 before the terminal is crimped, whereby the blocking performance of the gap can be more greatly improved as compared with a method using no adhesive agent. This embodiment is not limited to the coating and the gap may be wound by a sheet having adhesive agent. Accordingly, infiltration of water can be prevented.

Figure 5:
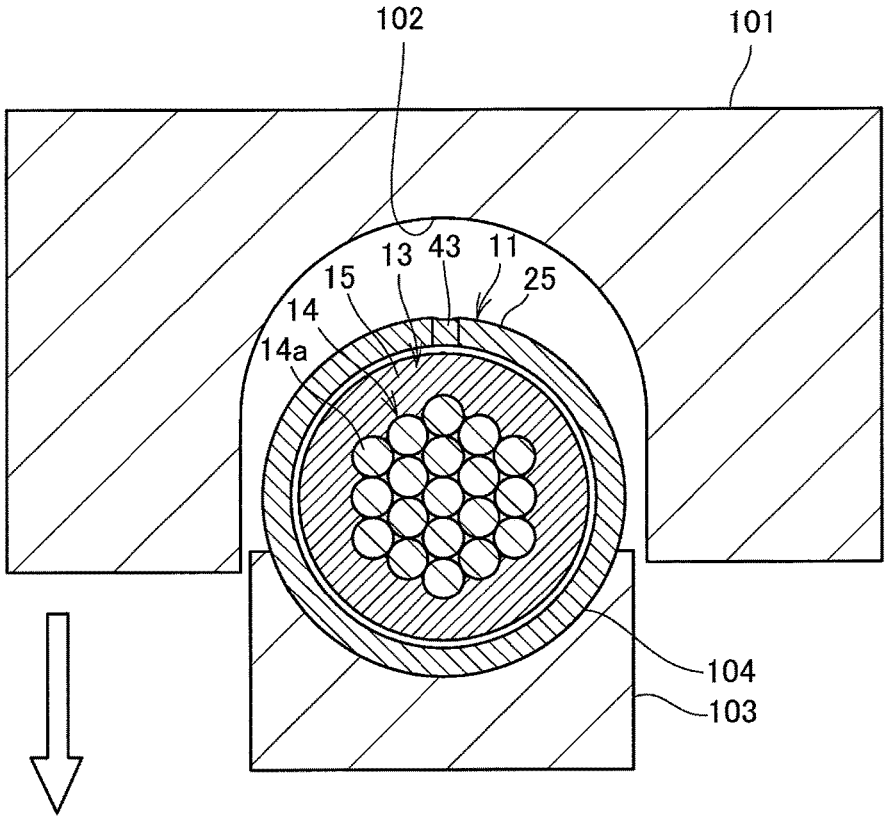
FIG. 5 is a diagram showing a specific example of a crimping step.

FIG. 5 is a diagram showing a specific example of the crimping step. The cross-section of the cover crimping portion 36 of the tube-shaped portion 25 (the cross-section vertical to the longitudinal direction of the electrical wire) is schematically shown together with the crimping parts. As shown in FIG. 5, the tube-shaped portion 25 of the terminal 11 and the insulating cover portion 15 of the electrical wire 13 are compressed and brought into close contact with each other by using the crimper 101 and the anvil 103. The crimper 101 has a crimping wall 102 extending along the outer shape of the terminal 11, and the anvil 103 has a receiving portion 104 on which the terminal 11 is mounted. The receiving portion 104 of the anvil 103 has a curved surface adaptable to the outer shape of the tube-shaped portion 25. As shown in FIG. 5, the terminal 11 is mounted on the receiving portion 104 under the state that the electrical wire 13 is inserted in the terminal 11, and the crimper 101 is descended as indicated by an arrow in FIG. 5, whereby the tube-shaped portion 25 is compressed by the crimping wall 102 and the receiving portion 104.

Next, examples of the electrical wire connecting structure 10 will be described together with comparative examples. This embodiment is not limited to the following examples.

Table 1 represents the correspondence relation between the specification (conductor cross-sectional area, electrical wire outer diameter, etc.) of the electrical wire 13 and the tube inner diameter of the tube-shaped portion 25 (the inner diameter of a site in which the core wire portion 14 is inserted). As shown in Table 1, five types of electrical wires 133 in which the conductor cross-sectional area in the direction vertical to the longitudinal direction of the electric wire 13 is set to 0.75 $mm^2$, 1.00 $mm^2$, 1.25 $mm^2$, 2.00 $mm^2$ and 2.50 $mm^2$ respectively are prepared. The terminal 11 having the tube-shaped portion 25 of 2.0 mm in tube inner diameter is used for the three types of electrical wires 13 of 0.75 to 1.25 $mm^2$ in conductor cross-sectional area. The terminal 11 having the tube-shaped portion 25 of 3.00 mm in tube inner diameter is used for the two types of electrical wires 13 of 2.00 to 2.50 $mm^2$.

TABLE 1

| CONDUCTOR CROSS-SECTIONAL AREA [$mm^2$] | CONDUCTOR STRUCTURE [number] | ELECTRICAL WIRE OUTER DIAMETER [mm] | TUBE INNER DIAMETER [mm] |
|---|---|---|---|
| 0.75 | 11 | 1.40 | 2.0 |
| 1.00 | 16 | 1.60 | 2.0 |
| 1.25 | 16 | 1.80 | 2.0 |
| 2.00 | 19 | 2.50 | 3.0 |
| 2.50 | 19 | 2.80 | 3.0 |

Here, the tube-shaped section 25 having the inner diameter of 2.0 mm is set for the three types of electrical wires 13 of 0.75 to 1.25 $mm^2$ in conductor cross-sectional area because the following condition is satisfied. That is, under the state that each of the three types of electrical wires 13 is covered with a general insulating cover portion 15, the diameter of the tube-shaped portion 25 is larger than the outer diameter of the electrical wire, or the tube-shaped portion 25 can be easily deformed so as to increase the diameter thereof even when the diameter of the tube-shaped portion 25 is smaller. In this correspondence relation between the electrical wire outer diameter and the tube inner diameter, the crimping connection can be easily performed by the method using the crimper 101 and the anvil 103 as shown in FIG. 5. Likewise, the tube-shaped portion 25 of 3.0 mm in inner diameter is set for the two types of electrical wires 13 of 2.00 to 2.50 $mm^2$ in conductor cross-sectional area because it is difficult to insert the electrical wire 13 concerned into the tube-shaped portion 25 of 2.0 mm in inner diameter under the state that the electrical wire 13 is covered with a general insulating cover portion 15, but the electrical wire 13 concerned is easily inserted into the tube-shaped portion 25 of 3.0 mm in inner diameter. In this correspondence relation between the electrical wire outer diameter and the tube inner diameter, the crimping connection can be easily performed by the method using the crimper 101 and the anvil 103 as shown in FIG. 5. In Table 1, it is described that the outer diameter of each of the five types of electrical wires 13 each having the insulating cover portion 15 ranges from 1.40 to 2.80 mm. However, in consideration of an error in design, the outer diameter ranges from 1.36 to 3.0 mm.

A metal member obtained by partially providing a tin layer on a metal base material of copper alloy FAS-680 (0.25 mm in thickness, H material) produced by Furukawa Electric Co., Ltd. was used as the metal member constituting the terminal 11. FAS-680 is Ni—Si type copper alloy. The tin layer was provided by plating.

Both the end portions of the C-shaped cross-section of the tube-shaped portion 25 which has been subjected to the bending work was made to face each other and subjected to laser welding so that the inner diameter thereof was equal to 2.0 mm or 3.0 mm, whereby the terminal 11 having the tube-shaped portion 25 of 2.0 mm in inner diameter (tube terminal) and the terminal 11 having the tube-shaped portion of 3.0 mm in inner diameter were manufactured. The adjustment of the inner diameter can be performed on the basis of the dimension of the chained terminal 151.

Wires formed of alloy components containing iron (Fe) of about 0.2 wt %, copper (Cu) of about 0.2 wt %, magnesium (Mg) of about 0.1 wt %, silicon (Si) of about 0.04 wt % and remaining portions of aluminum (Al) and unavoidable impurities were twisted and used as the core wire portion 14 of the electrical wire 13. The electrical wires 13 having the conductor cross-sectional areas shown in Table 1 were formed by using the core wire portion 14.

Resin containing polyvinyl chloride (PVC) as a main component was used for the insulating cover portion 15 of the electrical wire 13. The insulating cover portion 15 at the end portion of the electrical wire 13 was exfoliated from the electrical wire 13 by using a wire stripper to expose the end portion of the core wire portion 14.

Under this state, the electrical wire 13 was inserted into the tube-shaped portion 25 of the terminal 11 under the combinations of the electrical wire 13 and the tube inner diameter shown in Table 1, and the conductor crimping portion 35 of the tube-shaped portion 25 and the cover crimping portion 36 were partially strongly compressed and crimp-connected to each other by using the crimper 101 and the anvil 103, thereby manufacturing the electrical wire connecting structure 10.

100 samples of the electrical wire connecting structure 10 were prepared while the compressibility thereof was adjusted to be equal to 75%±5%. The compressibility is defined as the cross-sectional area ratio before and after crimping of the insulating cover portion 15 as described above, and it is determined by cross-sectionally cutting the crimped electrical wire 13 to expose the cross-section thereof, measuring the area of the insulating cover portion 15 and calculating the rate of the area concerned to the area before crimping.

An air leak test for checking whether there is any air leak from the gap between the tube-shaped portion 25 and the insulating cover portion 15 or the like was executed on the thus-prepared 100 samples. In this air leak test, air was fed into the electrical wire connecting structure 10 from the end portion side of the electrical wire 13 to which the terminal 11 was not connected while air pressure was increased, thereby checking the leakage. A criteria for passing was set to a condition that no leakage occurred under 10 kPa or less (air leak pressure was equal to 10 kPa or more). Air leak after thermal shock was applied (a cycle of leaving samples at −40° C. for 30 minutes and then leaving the samples at 120° C. for 30 minutes was conducted at 240 times) was conducted to check environmental resistance. The sample was also determined to pass when the air leak pressure was equal to 10 kPa or more. The number of samples which were determined to pass was counted from the 100 samples to calculate the pass ratio. The test result is shown in table 2.

TABLE 2

| | ELECTRICAL WIRE CONDUCTOR | TUBE | PERFORMANCE EVALUATION BASED ON AIR LEAK TEST (NUMBER OF PASSING SAMPLES/100) | |
|---|---|---|---|---|
| | CROSS-SECTIONAL AREA ($mm^2$) | INNER DIAMETER (mm) | INITIAL STAGE | AFTER THERMAL SHOCK |
| EMBODIMENTS | 0.75 | 1.5 | 100/100 | 99/100 |
| | 0.75 | 2.0 | 100/100 | 98/100 |
| | 1.25 | 2.0 | 100/100 | 100/100 |
| | 2.00 | 3.0 | 100/100 | 99/100 |
| | 2.50 | 3.0 | 100/100 | 100/100 |
| COMPARATIVE EXAMPLES | 0.75 | 3.0 | 83/100 | 67/100 |
| | 1.25 | 3.0 | 85/100 | 70/100 |
| | 2.00 | 4.0 | 88/100 | 72/100 |
| | 2.50 | 4.0 | 88/100 | 74/100 |

Table 2 shows test results of embodiments: the combination of the electrical wire 13 having the conductor cross-sectional area of 0.75 $mm^2$ in the direction vertical to the longitudinal direction and the tube-shaped portion 25 having the inner diameter of 1.5 mm; the combination of the electrical wire 13 having the conductor cross-sectional area of 0.75 $mm^2$ in the direction vertical to the longitudinal direction and the tube-shaped portion 25 having the inner diameter of 2.0 mm; the combination of the electrical wire 13 having the conductor cross-sectional area of 1.25 $mm^2$ in the direction vertical to the longitudinal direction and the tube-shaped portion 25 having the inner diameter of 2.0 mm; the combination of the electrical wire 13 having the conductor cross-sectional area of 2.00 $mm^2$ in the direction vertical to the longitudinal direction and the tube-shaped portion 25 having the inner diameter of 3.0 mm; and the combination of the electrical wire 13 having the conductor cross-sectional area of 2.50 $mm^2$ in the direction vertical to the longitudinal direction and the tube-shaped portion 25 having the inner diameter of 3.0 mm.

Furthermore, Table 2 also shows test results of comparative examples: the combination of the electrical wire 13 having the conductor cross-sectional area of 0.75 $mm^2$ in the direction vertical to the longitudinal direction and the tube-shaped portion 25 having the inner diameter of 3.0 mm; the combination of the electrical wire 13 having the conductor cross-sectional area of 1.25 $mm^2$ in the direction vertical to the longitudinal direction and the tube-shaped portion 25 having the inner diameter of 3.0 mm; the combination of the electrical wire 13 having the conductor cross-sectional area of 2.00 $mm^2$ in the direction vertical to the longitudinal direction and the tube-shaped portion 25 having the inner diameter of 4.0 mm; and the combination of the electrical wire 13 having the conductor cross-sectional area of 2.50 $mm^2$ in the direction vertical to the longitudinal direction and the tube-shaped portion 25 having the inner diameter of 4.0 mm.

As shown in Table 2, the test result of these samples indicates that no air leak was found in the initial (just after manufactured) air leak test and also little air leak was found even after the thermal shock with respect to all the combinations of the embodiments. On the other hand, with respect to the comparative examples, air leak was found in samples of about 15 to 17% out of all the samples at the time point of the initial air leak test, and air leak was also found in a larger number of samples of about 30% after the thermal shock. When ninety eight or more samples out of 100 samples pass the acceptance (pass) line, the combination can be practically applied to the actual manufacturing process. Therefore, it has been found that the combinations of the embodiments are suitable to block the gap between the electrical wire 13 and the tube-shaped portion 25 by compression. It has been found that when combinations different from the above excellent combinations are adopted, the gap between the electrical wire 13 and the tube-shaped portion 25 is excessively broad and thus it is difficult to sufficiently close the gap between the electrical wire 13 and the tube-shaped portion 25 by compression as exemplified by the comparative examples.

Furthermore, the inventors of this application prepared plural types of electrical wires 13 having conductor cross-sectional areas in the vertical direction to the longitudinal direction which were near to and not larger than the value of 0.75 $mm^2$ (hereinafter referred to as electrical wires A) and also prepared plural types of electrical wires 13 having conductor cross-sectional areas in the vertical direction to the longitudinal direction which were near to and not smaller than the value of 1.25 $mm^2$ (hereinafter referred to as electrical wires B), and crimp-connected these electrical wires to the tube-shaped portions 25 having the inner diameter of 2.0 mm to perform the same air leak test. As an example of the electrical wires A, an electrical wire 13 having a calculated cross-sectional area of 0.7266 $mm^2$ was prepared by using eleven electrical wires of 0.29 mm in diameter. As an example of the electrical wires B, an electrical wire 13 having a calculated cross-sectional area of 1.255 $mm^2$ was prepared by using nineteen electrical wires of 0.29 mm in diameter.

The test result of these electrical wires indicates that no air leak was found in the initial (just after manufactured) air leak test and little air leak was found even after the thermal shock. On the other hand, when the electrical wires A and B were crimp-connected to the tube-shaped portions 25 of 3.0 mm in inner diameter, air leak was liable to occur. The inventors have manufactured electrical wires 13 having various conductor cross-sectional areas and executed the air leak test as described above. As a result, the inventors have confirmed that air leak can be sufficiently suppressed for the tube-shaped portion 25 of 2.0 mm in inner diameter by using at least electrical wires 13 whose conductor cross-sectional area ranges from 0.72 to 1.37 $mm^2$. With respect to the electrical wires A and B, the compressibility under crimp-connection was set to 75%±5% as in the case of the above test.

Still furthermore, the inventors of this application prepared plural types of electrical wires 13 having conductor cross-sectional areas in the vertical direction to the longitudinal direction which were near to and not larger than the value of 1.25 $mm^2$ (hereinafter referred to as electrical wires P) and also prepared plural types of electrical wires 13 having conductor cross-sectional areas in the vertical direction to the longitudinal direction which were near to and not smaller than the value of 2.50 $mm^2$ (hereinafter referred to as electrical wires Q), and crimp-connected these electrical wires to the tube-shaped portions 25 having the inner diameter of 3.0 mm to perform the same air leak test. As an example of the electrical wires P, an electrical wire 13 having a calculated cross-sectional area of 1.247 $mm^2$ was prepared by using sixteen electrical wires of 0.315 mm in diameter. As an example of the electrical wires Q, an electrical wire 13 having a calculated cross-sectional area of 2.632 $mm^2$ was prepared by using nineteen electrical wires of 0.42 mm in diameter.

The test result of these electrical wires indicates that no air leak was found in the initial (just after manufactured) air leak test and little air leak was found even after the thermal shock. On the other hand, when the electrical wires P and Q were crimp-connected to the tube-shaped portions 25 of 4.0 mm in inner diameter, air leak was liable to occur. The inventors have manufactured electrical wires 13 having various conductor cross-sectional areas and executed the air leak test as described above. As a result, the inventors have confirmed that air leak can be sufficiently suppressed for the tube-shaped portion 25 of 3.0 mm in inner diameter by using at least electrical wires 13 whose conductor cross-sectional area ranges from 1.22 to 2.65 $mm^2$. With respect to the electrical wires P and Q, the compressibility under crimp-connection was set to 75%±5% as in the case of the above test.

As described above, according to this embodiment, the terminal 11 having the tube-shaped portion 25 of 2.0 mm in inner diameter is prepared for electrical wires 13 having conductor cross-sectional areas of 0.72 to 1.37 $mm^2$ in the vertical direction to the longitudinal direction, each of the electrical wires 13 is inserted into the tube-shaped portion 25, and the tube-shaped portion 25 and the core wire portion 14 of the electrical wire 13 are compressed to be crimp-connected to each other. Accordingly, the types of the terminals 11 adaptable to the electrical wires 13 in the above range can be reduced to one type, and the sufficient electrical wire holding force which can suppress air leak can be easily secured.

Furthermore, the terminal 11 having the tube-shaped portion 25 of 3.0 mm in inner diameter is prepared for electrical wires 13 having conductor cross-sectional areas of 1.22 to 2.65 $mm^2$ in the vertical direction to the longitudinal direction, each of the electrical wires 13 is inserted into the tube-shaped portion 25, and the tube-shaped portion 25 and the core wire portion 14 of the electrical wire 13 are compressed to be crimp-connected to each other. Accordingly, the types of the terminals 11 adaptable to the electrical wires 13 in the above range can be reduced to one type, and the sufficient electrical wire holding force which can suppress air leak can be easily secured. Accordingly, only two types of terminals 11 having tube-shaped portions 25 of 2.0 mm in inner diameter and terminals 11 having tube-shaped portions 25 of 3.0 mm in inner diameter may be prepared for electrical wires 13 ranging from 0.72 to 2.65 $mm^2$, so that the manufacturing of terminals and the management of terminals under crimping can be facilitated.

In this construction, the end portion of the tube-shaped portion 25 at the opposite side to the electrical wire insertion port 31 is closed, thereby forming a closed cylindrical body whose body is closed from the end portion at the opposite side to the electrical wire insertion port 31 except for the electrical wire insertion port 31. Therefore, the periphery of the electrical wire at the crimping portion is covered by the tube-shaped portion 25, and water or the like can be prevented from infiltrating from the opposite side to the electrical insertion port 31 of the tube-shaped portion 25. Accordingly, water hardly adheres to the core wire portion 14, and thus this is advantageous to securing of the water shutoff performance. Accordingly, corrosion of the tube-shaped portion 25 and/or the electrical wire 13 can be suppressed, and the lifetime of products can be lengthened. Furthermore, the inventors have studied and confirmed that electrical wire holding force which is enough to suppress air leak can be easily secured for the electrical wires 13 having the conductor cross-sectional areas of 0.72 to 1.37 $mm^2$ in the direction vertical to the longitudinal direction even when the terminals 11 having the tube-shaped portions 25 of 1.5 to 2.0 mm in inner diameter are combined with these electrical wires 13. With respect to the electrical wires 13 having the conductor cross-sectional areas of 1.22 to 2.65 $mm^2$ in the vertical direction to the longitudinal direction, it has been also confirmed that the electrical wire holding force which is enough to suppress air leak can be easily secured even by combining the terminals 11 having the tube-shaped portions 25 of 2.2 to 3.0 mm in inner diameter.

Therefore, the inner diameter of the tube-shaped portion 25 used to crimp the electrical wires 13 whose conductor sectional areas are set in the range from 0.72 to 1.37 $mm^2$ in the direction vertical to the longitudinal direction thereof may be selected from the range of 1.5 to 2.0 mm, and the inner diameter of the tube-shaped portion 25 used to crimp the electrical wires 13 whose conductor cross-sectional areas are set in the range from 1.22 to 2.65 $mm^2$ in the direction vertical to the longitudinal direction thereof may be selected from the range of 2.2 to 3.0 mm. Furthermore, in this construction, the electrical wire 13 (terminal cover-exfoliated electrical wire) inserted in the tube-shaped portion 25 has an excellent diameter relationship with the tube-shaped portion 25 and is excellently crimp-connected to the tube-shaped portion 25, so that the terminal connecting structure having excellent water shutoff performance can be provided. On the basis of this relationship, it is unnecessary to frequently adjust the tube inner diameter, and thus productivity can be enhanced. Furthermore, since the closed cylindrical body is formed by the process working and the laser welding, so that this embodiment is easily adaptable to mass production.

Second Embodiment

There is known a conventional terminal which is structured so that a flat connection piece and an electrical wire inserting cylindrical portion continuous with the flat connection piece are formed by crushing the front half portion of a conductor metal pipe, and a core wire portion which is exposed by exfoliating a cover therefrom is inserted into the electrical wire inserting cylindrical portion to be crimp-connected to the electrical wire inserting cylindrical portion (for example, Japanese Utility Model Registration No. 3019822). However, in the conventional structure, the boundary portion between the insulating cover portion and the core wire portion of the electrical wire is liable to be exposed to the outside. On the other hand, there may be considered such a structure that the terminal cover-exfoliated electrical wire is inserted in the tube-shaped portion like the electrical wire inserting cylindrical portion and the cover portion and the conductor portion of the electrical wire are integrally crimp-connected by compressing the cylindrical portion. However, in the case of the above structure, it is difficult to visually check how deeply the electrical wire is inserted, and thus it is difficult to manage the insertion amount of the electrical wire. In the case of a vehicle or the like, electrical wires having different sizes are used. Therefore, a crimping terminal is prepared every size, the types of the crimping terminals increase, and the terminal manufacturing and the terminal management under crimping become cumbersome. Therefore, in this embodiment, the electrical wire connecting structure 10 which can reduce the types of the crimping terminals and facilitate the management of the insertion amount of the electrical wire will be described. In the following description, the same construction as the first embodiment are represented by the same reference numerals, and duplicative description is omitted.

Figure 6:
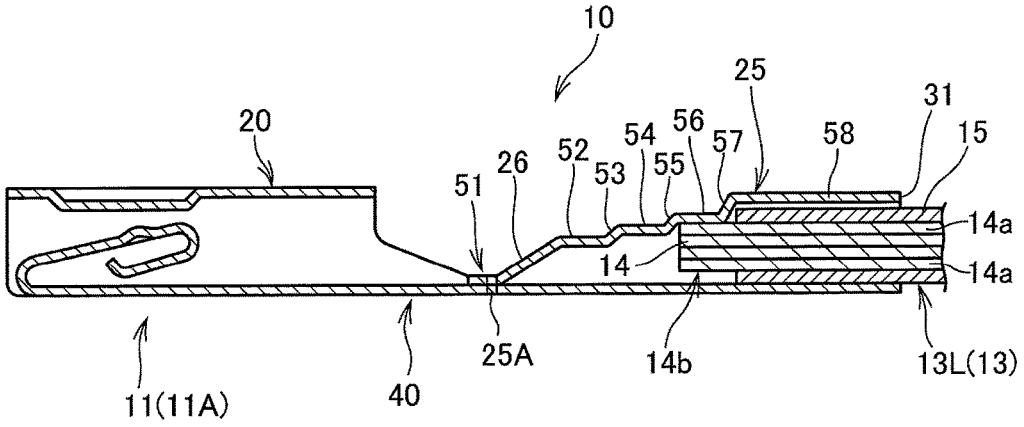
FIG. 6 is a cross-sectional view showing the cross-section of a terminal according to a second embodiment before crimping together with a large-diameter electrical wire.

FIG. 6 is a cross-sectional view showing the cross-section vertical to the longitudinal direction of the terminal 11 before crimping. As shown in FIG. 6, the tube-shaped portion 25 of the terminal 11 is a stepped tube (also called as a step tube) whose diameter stepwise increases from the transition portion 40 to the electrical wire insertion port 31 before crimping, and it is formed as a closed cylindrical body which is closed except for the electrical wire insertion port 31. More specifically, the tube-shaped portion 25 is integrally provided with a diameter-increasing portion (hereinafter referred to as first diameter-increasing portion) which gradually increases in diameter from the transition portion 40, a first cylinder portion 52 extending cylindrically from the edge portion of the first diameter-increasing portion 26 in the axial direction of the tube-shaped portion 25, a second diameter-increasing portion 53 which increases in diameter from the edge portion of the first cylinder portion 52, a second cylinder portion 54 extending cylindrically from the edge portion of the second diameter-increasing portion 53 in the axial direction of the tube-shaped portion 25, a third diameter-increasing portion 55 which increases in diameter from the edge portion of the second cylinder portion 54, a third cylinder portion 56 extending cylindrically from the edge portion of the third diameter-increasing portion 55 in the axial direction of the tube-shaped portion 25, a fourth diameter-increasing portion 57 increasing in diameter from the edge portion of the second cylinder portion 54, and a fourth cylinder portion 58 extending cylindrically from the edge portion of the fourth diameter-increasing portion 57 in the axial direction of the tube-shaped portion 25.

The stepped tube can be manufactured by punching a metal base material or a metal member like a shape obtained by flatly developing the stepped tube, subjecting the punched member to a bending (curling) work to curl the punched member so that the cross-section thereof is C-shaped, and butting and joining the opened end faces by welding or the like. That is, the stepped tube can be manufactured as in the case of the first embodiment although only the shape of the developed diagram is different.

In FIG. 6 and subsequent figures, a place which is strongly compressed when the tube-shaped portion 25 and the electrical wire 13 are crimp-connected to each other (the portion corresponding to the crimping mark 25B of FIGS. 2 and 3) is not shown, and it may be arbitrarily selected whether the strong compression should be performed or not.

Four kinds of cylinder portions different in inner diameter (the first cylinder portion 52, the second cylinder portion 54, the third cylinder portion 56 and the fourth cylinder portion 58) are formed in the tube-shaped portion 25, and the inner diameters of the cylinder portions 52, 54, 56 and 58 become larger as approaching to the electrical wire insertion port 31.

Except for the first cylinder portion 52 located at the forefront side, the cylinder portions (the second cylinder portion 54, the third cylinder portion 56 and the fourth cylinder portion 58) are designed to have interior shapes which enable the electrical wires 13 different in outer diameter to be inserted into the respective cylinder portions. The first cylinder portion 52 is designed to have an interior shape which enables the core wire portion 14 exposed from the electrical wire 13 having the smallest diameter out of the different electrical wire outer diameters to be inserted into the first cylinder portion 52.

FIG. 6 shows a state that the electrical wire 13 having the largest diameter out of the different electrical wire outer diameters to be inserted in the tube-shaped portion 25 (hereinafter represented by reference numeral 13L). As shown in FIG. 6, the outer diameter (finish diameter) of the electrical wire 13L having the largest diameter is the same to or smaller than the fourth cylinder portion 58, and also larger than the third cylinder portion 56. When this electrical wire 13L is inserted in the tube-shaped portion 25, the insulating cover portion 15 constituting the outermost periphery of the electrical wire 13L is insertable until it comes into contact with the fourth diameter-increasing portion 57 constituting the step portion between the fourth cylinder portion 58 and the third cylinder portion 56. Accordingly, the insertion length of the electrical wire 13L can be regulated to the position where the insulating cover portion 15 comes into contact with the fourth diameter-increasing portion 57, and thus the insertion lengths of the electrical wires 13L having the same outer diameter can be easily made uniform.

The insertion length of the electrical wire 13L may be set so as to satisfy predetermined specification conditions. For example, it is sufficient only to satisfy a condition for securing desired electrical wire holding force by the crimp connection between the tube-shaped portion 25 and the insulating cover portion 15, a condition for making the water shutoff performance be easily secured by crimp connection or the like, etc. FIG. 6 shows an example in which the length of the core wire portion 14 exposed at the terminal of the electrical wire 13 is set so that the core wire portion 14 comes into contact with the third diameter-increasing portion 55 constituting the step portion between the third cylinder portion 56 and the second cylinder portion 54. However, the insertion length of the core wire portion 14 is not limited to this example. When the contact area between the core wire portion 14 and the tube-shaped portion 25 is more greatly secured, the core wire portion 14 may be exposed by the length larger than that shown in FIG. 6, whereby the core wire portion 16 can be inserted till the inside of the second cylinder portion 54 or the inside of the first cylinder portion 52 or the like. In short, the insertion length of the core wire portion 14 may be set so that the contact area and the holding force between the core wire portion 14 and the tube-shaped portion 25 can be secured.

Figure 7:
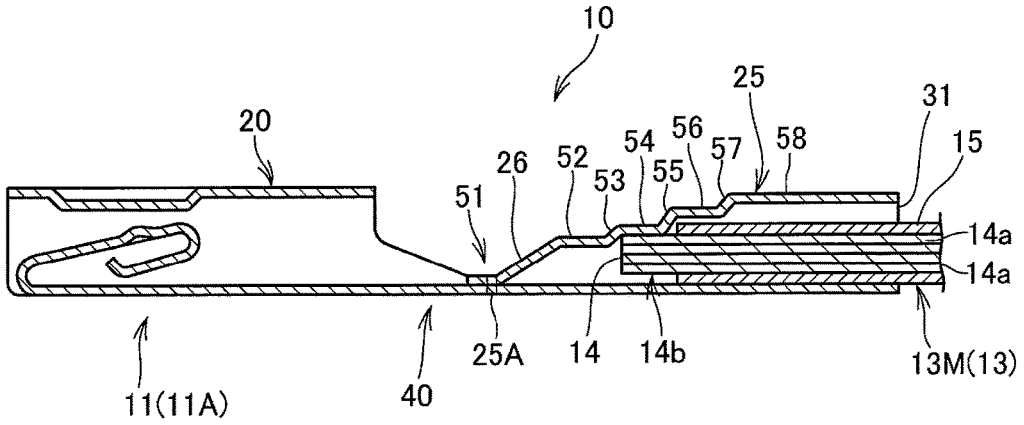
FIG. 7 is a cross-sectional view showing the cross-section of the terminal before crimping together with an middle-diameter electrical wire.

FIG. 7 shows a state that the electrical wire 13 having a smaller diameter than the electrical wire 13L (hereinafter represented by reference numeral 13L) is inserted in the tube-shaped portion 25 before crimping. The outer diameter of this electrical wire 13M is equal to or smaller than the diameter of the third cylinder portion 56, and larger than the diameter of the second cylinder portion 54. When the electrical wire 13M is inserted in the tube-shaped portion 25, the electrical wire 13M is insertable until the insulating cover portion 15 constituting the outermost periphery of the electrical wire 13M comes into contact with the third diameter-increasing portion 55 constituting the step portion between the third cylinder portion 56 and the second cylinder portion 54. Accordingly, the insertion length of the electrical wire 13M can be restricted to the length corresponding to the position where the insulating cover portion 15 comes into contact with the third diameter-increasing portion 55, and the insertion lengths of electrical wires 13M having the same outer diameter can be easily made uniform. The insertion length of the insulating cover portion 15 and the insertion length of the core wire portion 14 may be arbitrarily set so as to satisfy a predetermined specification condition.

Figure 8:
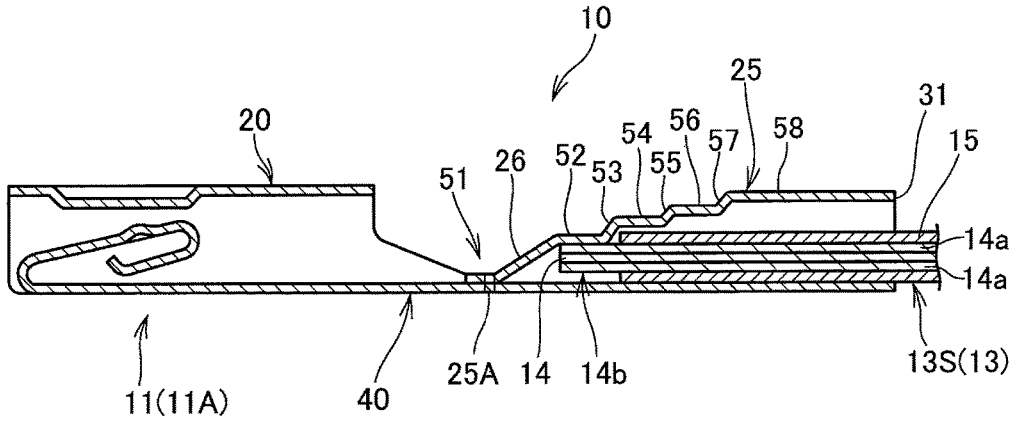
FIG. 8 is a cross-sectional view showing the cross-section of the terminal before crimping together with a small-diameter electrical wire.

FIG. 8 shows a state that the electrical wire 13 having a smaller diameter than the electrical wire 13M (hereinafter represented by reference numeral 13S) is inserted in the tube-shaped portion 25 before crimping. The outer diameter of the electrical wire 13S is equal to or smaller than the second cylinder portion 54, and larger than the first cylinder portion 52. When the electrical wire 13S is inserted in the tube-shaped portion 25, the electrical wire 13S is insertable until the insulating cover portion 15 constituting the outermost periphery of the electrical wire 13S comes into contact with the second diameter-increasing portion 53 constituting the step portion between the second cylinder portion 54 and the first cylinder portion 52. Accordingly, the insertion length of the electrical wire 13S can be restricted to the length corresponding to the position where the insulating cover portion 15 comes into contact with the second diameter-increasing portion 53, and the insertion lengths of the electrical wires 13S having the same outer diameter can be easily made uniform. The insertion length of the insulating cover portion 15 and the insertion length of the core wire portion 14 may be arbitrarily set so as to satisfy a predetermined specification condition.

Table 3 shows the specification (conductor cross-sectional area, electrical wire outer diameter, etc.) of electrical wires 13 which are planned to be used for wire harnesses for a vehicle.

TABLE 3

| CONDUCTOR CROSS-SECTIONAL AREA [$mm^2$] | CONDUCTOR STRUCTURE [number] | ELECTRICAL WIRE OUTER DIAMETER [mm] |
|---|---|---|
| 0.75 | 11 | 1.40 |
| 1.00 | 16 | 1.60 |
| 1.25 | 16 | 1.80 |
| 2.00 | 19 | 2.50 |
| 2.50 | 19 | 2.80 |

As shown in Table 3, there are provided five types of electrical wires 13 having conductor cross-sectional areas of 0.75 $mm^2$, 1.00 $mm^2$, 1.25 $mm^2$, 2.00 $mm^2$ and 2.50 $mm^2$ in the direction vertical to the longitudinal direction. A first terminal 11A used for crimping of the electrical wires 13 of 0.75 $mm^2$, 1.00 $mm^2$ and 1.25 $mm^2$ and a second terminal 11B used for crimping of the electrical wires 13 of 2.00 $mm^2$ and 2.50 $mm^2$ are manufactured as the terminals 11 used for crimping of the above electrical wires 13. The terminal 11A out of these terminals corresponds to the terminal 11 shown in FIGS. 6 to 8, and it will be described more specifically described below.

As shown in FIG. 8, the diameter of the first cylinder portion 52 of the terminal 11 is set to a value which enables the core wire portion 14 of the electrical wire 13 having the conductor cross-sectional area of 0.75 $mm^2$ in the direction vertical to the longitudinal direction to be inserted in the first cylinder portion 52 of the terminal 11, and also is smaller than the outer diameter of the electrical wire 13. The insulating cover portion 15 of the electrical wire 13 having the conductor cross-sectional area of 0.75 $mm^2$ or more in the direction vertical to the longitudinal direction is impossible to easily infiltrate into the first cylinder 52 of the terminal 11. As shown in FIGS. 7 and 8, the diameter of the second cylinder portion 54 is set to be substantially equal to or larger than the outer diameter of the electrical wire 13 having the conductor cross-sectional area of 0.75 $mm^2$ in the direction vertical to the longitudinal direction, and also smaller than the outer diameter of the electrical wire 13 having the conductor cross-sectional area of 1.00 $mm^2$ in the direction vertical to the longitudinal direction (corresponds to 13M). Accordingly, the infiltration of the insulating cover portion 15 of the electrical wire 13 having the conductor cross-sectional area of 0.75 $mm^2$ in the direction vertical to the longitudinal direction is permitted, and the infiltration of the insulating cover portion 15 of the electrical wire 13 having the conductor cross-sectional area of 1.00 $mm^2$ or more in the direction vertical to the longitudinal direction can be restricted.

As shown in FIGS. 6 and 8, the diameter of the third cylinder portion 56 is set to be substantially equal to or larger than the outer diameter of the electrical wire 13 having the conductor cross-sectional area of 1.00 $mm^2$ in the direction vertical to the longitudinal direction, and also smaller than the outer diameter of the electrical wire 13 having the conductor cross-sectional area of 1.25 $mm^2$ in the direction vertical to the longitudinal direction (corresponds to 13L). Accordingly, the infiltration of the insulating cover portion 15 of the electrical wire 13 having the conductor cross-sectional area of 1.00 $mm^2$ in the direction vertical to the longitudinal direction is permitted, and the infiltration of the insulating cover portion 15 of the electrical wire 13 having the conductor cross-sectional area of 1.25 $mm^2$ or more in the direction vertical to the longitudinal direction can be restricted. Furthermore, the diameter of the fourth cylinder portion 58 is set to be substantially equal to or larger than the outer diameter of the electrical wire 13 having the conductor cross-sectional area of 1.25 $mm^2$ in the direction vertical to the longitudinal direction, and also smaller than the outer diameter of the electrical wire 13 having the conductor cross-sectional area of 1.50 $mm^2$ in the direction vertical to the longitudinal direction (not shown). Accordingly, the infiltration of the insulating cover portion 15 of the electrical wire 13 having the conductor cross-sectional area of 1.25 $mm^2$ in the direction vertical to the longitudinal direction is permitted, and the infiltration of the insulating cover portion 15 of the electrical wire 13 having the conductor cross-sectional area of 1.50 $mm^2$ or more in the direction vertical to the longitudinal direction can be restricted.

Accordingly, the first terminal 11A is designed in such a tube-like shape that the electrical wires 13 having the conductor cross-sectional areas of 0.75 $mm^2$, 1.00 $mm^2$ and 1.25 $mm^2$ in the direction vertical to the longitudinal direction can be inserted in the first terminal 11A, and each of the insertion lengths of the insulating cover portions 15 of the electrical wires 13 having the conductor cross-sectional areas of 0.75 $mm^2$, 1.00 $mm^2$ and 1.25 $mm^2$ in the direction vertical to the longitudinal direction can be set to a fixed length. Accordingly, even when the terminal 11 is constructed to be crimp-connected to the insulating cover portion 15 and the core wire portion 14 of the electrical wire 13 and also designed as a closed cylindrical body in which the inserted electrical wire 13 cannot be visually checked, the insertion amounts of plural types of electrical wires 13 can be easily managed without relying on visual sense.

With respect to the second terminal 11B used for crimping of the electrical wires 13 having the conductor cross-sectional areas of 2.0 $mm^2$ and 2.50 $mm^2$ in the direction vertical to the longitudinal direction, infiltration of the insulating cover portion 15 of the electrical wire 13 having the area of the conductor of 2.00 $mm^2$ in the cross-section vertical to the longitudinal direction is permitted as not shown. This terminal 11B is manufactured by providing a cylinder portion (corresponding to the third cylinder portion 56 in FIGS. 6 to 8, for example) for restricting infiltration of the insulating cover portion 15 of the electrical wire having the conductor cross-sectional area of 2.50 $mm^2$ in the direction vertical to the longitudinal direction, and providing at the electrical wire insertion port 31 side a cylinder portion (corresponding to the fourth cylinder portion 58 in FIGS. 6 to 8, for example) for permitting the insulating cover portion 15 of the electrical wire having the conductor cross-sectional area of 2.50 $mm^2$ in the direction vertical to the longitudinal direction through a diameter-increasing portion increasing in diameter (corresponding to the fourth diameter-increasing portion 57 in FIGS. 6 to 8, for example) from the edge portion of the cylinder portion.

Accordingly, the second terminal 11 is designed in such a tube-like shape that the electrical wires 13 having the conductor cross-sectional areas 2.00 $mm^2$ and 2.50 $mm^2$ in the direction vertical to the longitudinal direction can be easily inserted, and each of the insertion lengths of the insulating cover portions 15 of the electrical wires 13 having the conductor cross-sectional areas of 2.00 $mm^2$ and 2.50 $mm^2$ in the direction vertical to the longitudinal direction can be set to a fixed length. Accordingly, the insertion amount of the electrical wire can be easily managed without relying on the visual sense. In the second terminal 11B, the portions corresponding to the first cylinder portion 52 and the second diameter-increasing portion 53 in FIGS. 6 to 8 can be omitted.

In this terminal 11, the range from 1.5 to 2.0 mm in inner diameter is preferable to the second and third cylinder portions 54, 56 as the crimping sites of the electrical wire 13 whose conductor cross-sectional area ranges from 0.75 to 1.25 $mm^2$ in the direction vertical to the longitudinal direction. By setting the inner diameter in this range, the electrical wire holding force which can sufficiently suppress air leak can be easily secured as described with reference to the first embodiment. Furthermore, the range from 1.5 to 2.0 mm in inner diameter is preferable to the connection of the electrical wire 13 having the conductor cross-sectional area ranging from 0.72 to 1.37 $mm^2$ in the direction vertical to the longitudinal direction. Therefore, for example, the electrical wire 13 having the conductor cross-sectional area of 0.72 $mm^2$ in the direction vertical to the longitudinal direction may be crimp-connected to the second cylinder portion 54, and the electrical wire 13 having the conductor cross-sectional area of 1.37 $mm^2$ in the direction vertical to the longitudinal direction may be crimp-connected to the third cylinder portion 56. That is, any one of the electrical wires 13 having the conductor cross-sectional areas ranging from 0.72 to 1.37 $mm^2$ in the direction vertical to the longitudinal direction may be arbitrarily crimp-connected to the second and third cylinder portions 54, 56.

The range of 2.2 to 3.0 mm in inner diameter is preferable to the third and fourth cylinder portions 56, 58 as the crimping sites of the electrical wire 13 having the conductor cross-sectional area ranging from 1.25 to 2.50 $mm^2$ in the direction vertical to the longitudinal direction. By setting this range, the sufficient electric wire holding force which can suppress air leak can be easily secured as described with reference to the first embodiment. Furthermore, the range from 2.2 to 3.0 mm in inner diameter is preferable to the connection of the electrical wire 13 having the conductor cross-sectional area ranging from 1.22 to 2.65 $mm^2$ in the direction vertical to the longitudinal direction. Therefore, this is suitable to arbitrarily crimp and connect any one of the electrical wires 13 having the conductor cross-sectional area ranging from 1.22 to 2.65 $mm^2$ in the direction vertical to the longitudinal direction.

When the electrical wire 13 is crimped to the terminal 11, as shown in FIGS. 6 to 8, the electrical wire 13 from which the insulating cover portion 15 at the terminal thereof is exfoliated (that is, the terminal cover exfoliated electrical wire) is inserted into the tube-shaped portion 25 of the terminal 11 until it impinges against the step portion (the second to fourth diameter-increasing portions 53, 55, 57), and the tube-shaped portion 25 is compressed, whereby the tube-shaped portion 25, the insulating cover portion 15 and the core wire portion 14 are integrally crimp-connected to one another.

The crimping step is performed by using the crimper 101 and the anvil 103 as in the case of the first embodiment. The cross-sectional diagram of the cover crimping portion 36 of the tube-shaped portion 25 is the same as FIG. 5, and the lateral cross-sectional diagram after crimping is also the same as FIG. 3(A). That is, as shown in FIG. 5, the terminal 11 and the electrical wire 13 are crimp-connected (swaged) to each other by using the crimper 101 and the anvil 103. The crimper 101 has a crimping wall 102 extending along the outer shape of the terminal 11, and the anvil 103 has a receiving portion 104 on which the terminal 11 is mounted. The receiving portion 104 of the anvil 103 is designed to have a curved surface corresponding to the outer shape of the tube-shaped portion 25.

As shown in FIG. 5, the terminal 11 is mounted on the receiving portion 104 and the crimper 101 is descended as indicated by an arrow in FIG. 5 under the state that the electrical wire 13 is inserted in the terminal 11, whereby the tube-shaped portion 25 is compressed by the crimping wall 102 and the receiving portion 104 and crimp-connected to the electrical wire 13.

The depths of the crimper 101 and the anvil 103 are set so that substantially the whole of the tube-shaped portion 25 excluding the diameter-increasing portion 26 can be compressed, whereby the crimp-connection between the tube-shaped portion 25 and the insulating cover portion and the crimp-connection between the tube-shaped portion 25 and the core wire portion 14 can be performed at the same time. Furthermore, the crimp-connection between the tube-shaped portion 25 and the insulating cover portion 15 and the crimp-connection between the tube-shaped portion 25 and the core wire portion 14 may be performed separately from each other.

As shown in FIG. 3, at the tube-shaped portion 25, the metal base material (or the metal member) constituting the tube-shaped portion 25 and the electrical wire 13 are partially strongly compressed from the outside, thereby establishing the mechanical connection and the electrical connection. That is, when the tube-shaped portion 25 and the electrical wire 13 are crimp-connected to each other, the tube-shaped portion 25 is plastically deformed, so that the tube-shaped portion 25 is compressed and deformed along the outer shape of the electrical wire 13 so as to suppress the whole of the electrical wire 13 in the tube-shaped portion 25.

Therefore, after the crimp-connection, the boundaries among the first diameter-increasing portion 26, the first cylinder portion 52, the second diameter-increasing portion 53, the third diameter-increasing portion 55, the third cylinder portion 56, the fourth diameter-increasing portion 57 and the fourth cylinder portion 58 shown in FIG. 8, etc. are unclear (see FIG. 2), and thus the whole of the electrical wire 13 in the tube-shaped portion 25 can be sufficiently pressed. In this case, as shown in FIG. 3, the conductor crimping portion 35 at which the tube-shaped portion 25 and the core wire portion 14 are crimp-connected to each other, and the cover crimping portion 36 at which the tube-shaped portion 25 and the core wire portion 14 are crimp-connected to each other are formed, thereby securing the mechanical and electrical connection.

A shown in FIG. 3, the tube-shaped portion 25 of this construction is formed in a tube-shape having a bottom which is closed at one end and open at the other end (closed tube-shaped body), and thus infiltration of water or the like from the one end side can be suppressed. When a large gap exists between the terminal 11 and the insulating cover portion 15 of the electrical wire 13 at the other end side of the tube-shaped portion 25, water may infiltrate from the gap and adhere to the core wire portion 14. When water adheres to the connection portion between the metal base material (or the metal member) of the terminal 11 and the core wire portion 14, there occurs a phenomenon that corrosion progresses due to the difference in electromotive force between both the metal materials (ionization tendency) (that is, electrical corrosion), and thus there occurs a problem that the lifetime of products is shortened. In this construction, as described above, the tube diameter of the tube-shaped portion 25 which is crimp-connected to the insulating cover portion 15, that is, the respective tube diameters of the second, third and fourth cylinder portions 54, 56, 58 are set to be matched with the different outer diameters of the electrical wires 13. Therefore, the tube diameters can be set to tube diameters suitable for securing the water shut-off performance. Accordingly, even when an electrical wire 13 having any electrical wire outer diameter is crimp-connected, infiltration of water can be easily suppressed.

As described above, according to the embodiment, as shown in FIGS. 6 to 8, the tube-shaped portion 25 of the terminal 11 in which the electrical wire (the terminal cover exfoliated electrical wire) 13 is inserted and which is integrally crimp-connected to the insulating cover portion 15 and the core wire portion 14 of the electrical wire 13 by press-fitting is designed as a stepped tube having plural pipe aperture diameters corresponding to the diameters of the insulating cover portions 15. Therefore, the types of terminals 11 used for electrical wires 13 having plural outer diameters can be reduced, and also the management of the electrical wire insertion length can be facilitated. In this embodiment, the inner diameter to the tube-shaped portion 25 used for the crimp-connection of the electrical wire 13 having the conductor cross-sectional area of 0.72 to 1.37 $mm^2$ in the direction vertical to the longitudinal direction is set in the range from 1.5 to 2.0 mm, and the inner diameter of the tube-shaped portion 25 used for the crimp-connection of the electrical wire 13 having the conductor cross-sectional area of 1.22 to 2.65 $mm^2$ in the direction vertical to the longitudinal direction is set in the range from 2.2 to 3.0 mm as in the case of the first embodiment. Therefore, the electrical holding force which is enough to suppress air leak can be easily secured.

In addition, the terminal 11 is configured to have a closed cylindrical body in which the end portion thereof at the opposite side to the electrical wire insertion port (open portion) 31 in which the electrical wire 13 is inserted is closed and which extends cylindrically and continuously from the closed end portion to the electrical wire insertion port 31 while closed except for the electrical wire insertion port 31. Therefore, the electrical wire 13 inserted in the terminal 11 cannot be visually checked. Even in such a construction, the insertion amount of the electrical wire can be easily managed without relying on the visual sense. Furthermore, the terminal 11 has a tube aperture diameter which is larger as approaching to the electrical wire insertion port 31. Therefore, the electrical wires 13 having plural outer diameters can be easily inserted.

In this construction, the terminal 11 has the plural tube aperture diameters corresponding to the diameters of the insulating cover portions 15 of the electrical wires 13 of two or more having the conductor cross-sectional areas ranging from 0.72 to 2.65 $mm^2$ in the direction vertical to the longitudinal direction. Therefore, the type of the terminals 11 can be made common to the electrical wires 13 having the plural outer diameters used for a wire harness for a vehicle. The plural tube aperture diameters in the terminal 11 are respectively set to the tube diameters suitable for water shutoff performance in conformity with the outer diameters of the electrical wires 13, whereby the water shutoff performance can be enhanced and the electrical corrosion can be suppressed. This effect is particularly remarkable when the base material of the terminal 11 (tube-shaped portion 25) is formed of copper or copper alloy and the conductor portion of the electrical wire 13 is formed of aluminum or aluminum alloy.

Furthermore, according to this construction, the electrical wire connecting structure 10 is manufactured by a manufacturing process comprising a step (forming step) of manufacturing a terminal 11 of a stepped tube having plural tube aperture diameters corresponding to the outer diameters of the insulating cover portions 15 of electrical wires 13, a step of inserting the electrical wire 13 until the insulating cover portion 15 comes into contact with a predetermined step portion (second to fourth diameter-increasing portions 53, 55, 57) of the terminal 11, and a step of compressing the terminal 11 to integrally crimp-connect the terminal 11 to the insulting cover portion 15 and the core wire portion 14, and thus there can be easily provided the electrical wire connecting structure 10 which can reduce the types of the terminals 11 used for the electrical wires 13 having the plural outer diameters and the management of the electric wire insertion amount can be easily performed.

<Compressibility of Cover>

In the terminal 11 described above, a water shut-off performance test was executed with respect to the cover compressibility of the electrical wire 13 (the terminal cover exfoliated electrical wire) inserted in the tube-shaped portion 25. The test will be described below. Copper alloy FAS-680 (thickness of 0.25 mm, H material) produced by Furukawa Electric Co., Ltd. was used as the base material of the terminal 11. FAS-680 is Ni—Si type copper alloy. A metal member was formed by providing a tin layer on the base material and used. The tin layer was provided by plating.

Element wires 14*a* formed of Al—Mg—Si type aluminum alloy wires were used as the core wire portion 14 of the electrical wire 13. The electrical wires 13 having the conductor cross-sectional areas (the total area of the core wire portion 14 in the cross-section vertical to the longitudinal direction) shown in Table 3 were formed by using the core wire portion 14.

Resin containing polyvinyl chloride (PVC) as a main component was used for the insulating cover portion 15 of the electrical wire 13. The insulating cover portion 15 at the end portion of the electrical wire was exfoliated from the electrical wire 13 by a wire stripper to expose the core wire portion 14. The thus-manufactured electrical wire 13 was inserted in the tube-shaped portion 25 of the terminal 11, and the conductor crimping portion 35 of the tube-shaped portion 25 and the cover crimping portion 36 were partially strongly compressed by using the crimper 101 and the anvil 103 to be crimp-connected to the electrical wire 13, thereby manufacturing the electrical wire connecting structure 10. This crimp-connection was performed so that the compressibility of the insulating cover portion 15 (hereinafter referred to as "cover compressibility" ranged from 70% to 90%.

The cover compressibility is the area ratio of the insulating cover portion 15 before and after crimp-connection, and it is obtained by cutting the crimp-connected electrical wire 13 along the cross-section vertical to the longitudinal direction to expose the cross-section of the insulating cover portion 15, measuring the area of the insulating cover portion 15 and calculating the rate of the cross-sectional area after the crimp-connection to the cross-sectional area before the crimp-connection. Plural types of electrical wire connecting structures 10 different in cover compressibility were manufactured, and the air leak test was conducted on these electrical wire connecting structures 10 to check whether there was any air leak from the gap between the tube-shaped portion 25 and the insulating cover portion 15. The air leak test was conducted according to a method of gradually increasing air pressure from the end portion of the electrical wire 13 which was not connected to the terminal 11 and applying the air pressure of 50 kPa to the electrical wire connecting structure 10 for 30 minutes to check leak, and then likewise check air leak after lapse of 120 hours at 120° C. The test result is shown in Table 4.

TABLE 4

| CONDUCTOR CROSS-SECTIONAL AREA | COVER COMPRESSIBILITY (AVERAGE COMPRESSIBILITY) | AIR LEAK | AIR LEAK AFTER 100 HOURS AT 120° c. | |
|---|---|---|---|---|
| 2.50 mm$^2$ | 98 | X | X | COMPARATIVE EXAMPLE 1 |
| | 95 | ○ | X | COMPARATIVE EXAMPLE 2 |
| | 91 | ◎ | X | COMPARATIVE EXAMPLE 3 |
| | 85 | ◎ | ○ | EMBODIMENT 1 |
| | 75 | ◎ | ◎ | EMBODIMENT 2 |
| | 70 | ◎ | ○ | EMBODIMENT 3 |

TABLE 4-continued

| CONDUCTOR CROSS-SECTIONAL AREA | COVER COMPRESSIBILITY (AVERAGE COMPRESSIBILITY) | AIR LEAK | AIR LEAK AFTER 100 HOURS AT 120° c. | |
|---|---|---|---|---|
| | 65 | ◎ | ○ | EMBODIMENT 4 |
| | 60 | ◎ | X cover destructed | COMPARATIVE EXAMPLE 4 |
| | 58 | ○ | X cover destructed | COMPARATIVE EXAMPLE 5 |
| | 50 | ○ | X cover destructed | COMPARATIVE EXAMPLE 6 |
| 0.75 mm$^2$ | 99 | X | X | COMPARATIVE EXAMPLE 7 |
| | 84 | ◎ | ○ | EMBODIMENT 5 |
| | 75 | ◎ | ◎ | EMBODIMENT 6 |
| | 65 | ◎ | ○ | EMBODIMENT 7 |
| | 50 | ○ | X cover destructed | COMPARATIVE EXAMPLE 8 |

In Table 4, the test result is estimated by four steps.
◎ (double circle) . . . no air leak was observed even at air pressure of 50 kPa.
○ (single circle) . . . no air leak was observed at air pressure less than 30 kPa, but air leak was observed at air pressure of 30 to 50 kPa.
Δ (triangle) . . . no air leak was observed at air pressure less than 1 to 5 kPa, but air leak was observed at air pressure of 5 to 30 kPa.
X (ex) . . . air leak was observed at air pressure of 1 to 5 kPa.

Table 4 shows a test result of the electrical wire 13 having the conductor cross-sectional area of 2.5 mm$^2$ in the direction vertical to the longitudinal direction, and the electrical wire 13 having the conductor cross-sectional area of 0.75 mm$^2$ in the direction vertical to the longitudinal direction. With respect to the electrical wire 13 having the conductor cross-sectional area of 2.50 mm$^2$ in the direction vertical to the longitudinal direction, the cover compressibility (average compressibility) is set to 90% in Embodiment 1, 80% in Embodiment 2, 75% in Embodiment 3, and 70% in Embodiment 4. With respect to the electrical wire 13 having the conductor cross-sectional area of 0.75 mm$^2$ in the direction vertical to the longitudinal direction, the cover compressibility is set to 89% in Embodiment 5, 80% in Embodiment 6 and 70% in Embodiment 7. On the other hand, with respect to the electrical wire 13 having the conductor cross-sectional area of 2.50 mm$^2$ in the direction vertical to the longitudinal direction, the cover compressibility is set to 98% in Comparative Example 1, 95% in Comparative Example 2, 93% in Comparative Example 3, 65% in Comparative Example 4, 63% in Comparative Example 5, and 55% in Comparative Example 6. With respect to the electrical wire 13 of 0.75 mm$^2$, the cover compressibility is set to 99% in Comparative Example 7, and 55% in Comparative Example 8.

As shown in Table 4, in the embodiments 1 to 7, no air leak was observed under the air pressure less than 30 kPa, and the cover compressibility was equal to 70% to 90%. In the embodiments 2 and 6, no air leak was also observed under the air pressure of 50 kPa, and this was an excellent result. The cover compressibility was equal to 80%. On the other hand, air leak was observed in the comparative examples 1 to 8, that is, in the range where the cover compressibility was more than 90% and also less than 70%. Accordingly, it has been found that the water shutoff performance between the tube-shaped portion 25 and the insulating cover portion 15 can be sufficiently secured and corrosion can be suppressed by setting the cover compressibility in the range from 70% to 90%. Furthermore, when the water shutoff performance is more enhanced, it has been found that it is preferable to set the cover compressibility to 80% or in a range (75% to 85%) around 80%. The inventors have had the same knowledge for the electrical wire connecting structure 10 to which the electrical wires 13 having other electrical wire outer diameters are crimp-connected.

With respect to the compressibility of the conductor crimping portion 35 (hereinafter referred to as conductor compressibility (also called as core wire compressibility)), it has been confirmed through the inventors' test that it is favorable to set the conductor compressibility in the range from 45% to 85%, more preferably in the range from 50% to 75% from the viewpoint of the electrical wire holding force and the conduction. The cover compressibility and the conductor compressibility as described above may be satisfied by setting the crimp height (the height after the crimping portion is crimped) and the crimp wide (the width after the crimping portion is crimped), and thus the crimping step is not complicated.

As described above, in this construction, the electrical wire 13 inserted in the tube-shaped portion 25 (the terminal cover exfoliated electrical wire) is crimped by the cover compressibility of 70% to 90%, so that the water shutoff performance can be more greatly enhanced and the corrosion of the terminal cover exfoliated electrical wire can be more greatly suppressed. According to this construction, addition of a part and a specific step are not necessary, and the water shutoff performance can be easily enhanced as compared with a structure that the water shutoff performance is enhanced by using anticorrosion agent and solder or the like. Furthermore, the water shutoff performance can be enhanced by the same crimping work as a general crimping work, and thus the productivity can be also enhanced. The tube-shaped portion 25 of the terminal 11 is formed by punching the plate material of the metal base material or metal member, pressing the punched material in C-shape, welding both the end faces of the C-shaped material and crushing the tip of the welded material for internal sealing. Therefore, the productivity of the tube-shaped portion 25 which is excellent in corrosion-proof performance and water shutoff performance can be enhanced.

Third Embodiment

Figure 9:
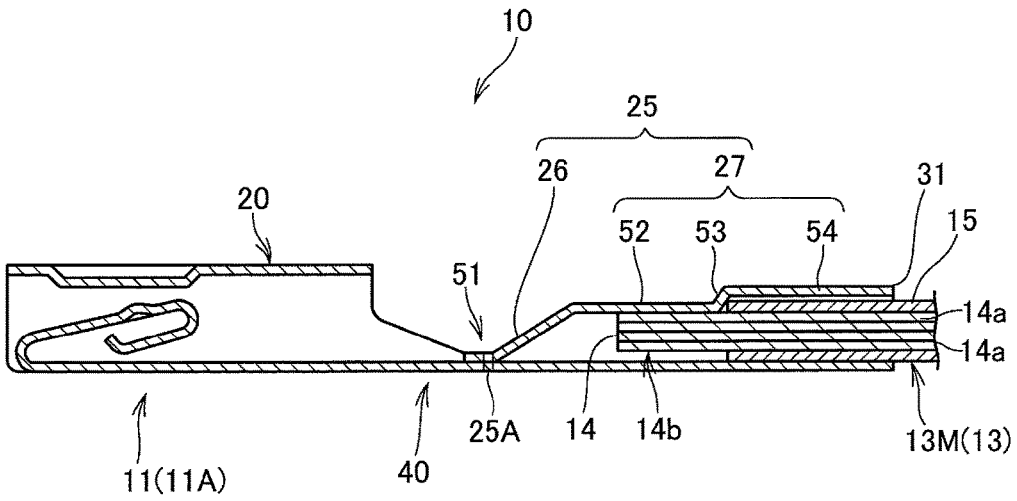
FIG. 9 is a cross-sectional view showing a state of an electrical wire connecting structure according to a third embodiment before crimp connection.

FIG. 9 is a cross-sectional view showing a state of the electrical wire connection structure 10 according to a third embodiment before crimp-connection. The third embodiment is the same as the first embodiment except that the tube-shaped portion 25 of the terminal 11 is designed as a stepped tube (also called as a step tube) which increases in diameter from the transition portion 40 to the electrical wire insertion port 31 by only one step. In the following description, the same constructions as the above embodiment are represented by the same reference numerals, and duplicative description is omitted.

More specifically, the cylinder portion 27 of the tube-shaped portion 25 has integrally a first cylinder portion 52 which extends in a cylindrical shape from the edge portion of the diameter-increasing portion (first diameter-increasing portion) 26 in the axial direction of the tube-shaped portion 25, a second diameter-increasing portion 53 increasing in diameter from the edge portion of the first cylinder portion 52, and a second cylinder portion 54 which extends in a cylindrical shape from the edge portion of the second diameter-increasing portion in the axial direction of the tube-shaped portion 25.

According to this construction, the tube-shaped portion 25 has two types of cylinder portions (first cylinder portion 52, second cylinder portion 54) which increases in diameter as approaching to the electrical wire insertion port 31. The small-diameter first cylinder portion 52 is designed to have an internal shape in which the core wire portion 14 (core wire portion tip portion 14*b*) is insertable, and formed to be smaller in diameter than the outer diameter of the insulating cover portion 15 (cover tip portion 15*a*). The correspondence relation between the tube inner diameter of the first cylinder portion 52 and the specification (conductor cross-sectional area electrical wire outer diameter, etc.) of the electrical wire 13 is the same as the correspondence relation between the tube inner diameter and the specification of the electrical wire 13 shown in Table 1. The large-diameter second cylinder portion 54 is formed to have a diameter which enables insertion of the insulating cover portion 15 (cover tip portion 15*a*) in the second cylinder portion 54.

According to this construction, as shown in FIG. 9, the insertion of the insulating cover portion 15 into the first cylinder portion 52 can be controlled, and the insertion lengths of the electrical wires 13 can be easily made uniform. Furthermore, as compared with the first embodiment, the inner diameter of the electrical wire insertion port 31 (corresponding to the tube inner diameter of the second cylinder portion 54) can be increased, and thus there can be obtained an effect that the electrical wire 13 can be easily inserted. The crimp-connection is performed as in the case of the first embodiment. Therefore, the state after the crimp-connection is the same as shown in FIGS. 2 and 3.

Figure 10:
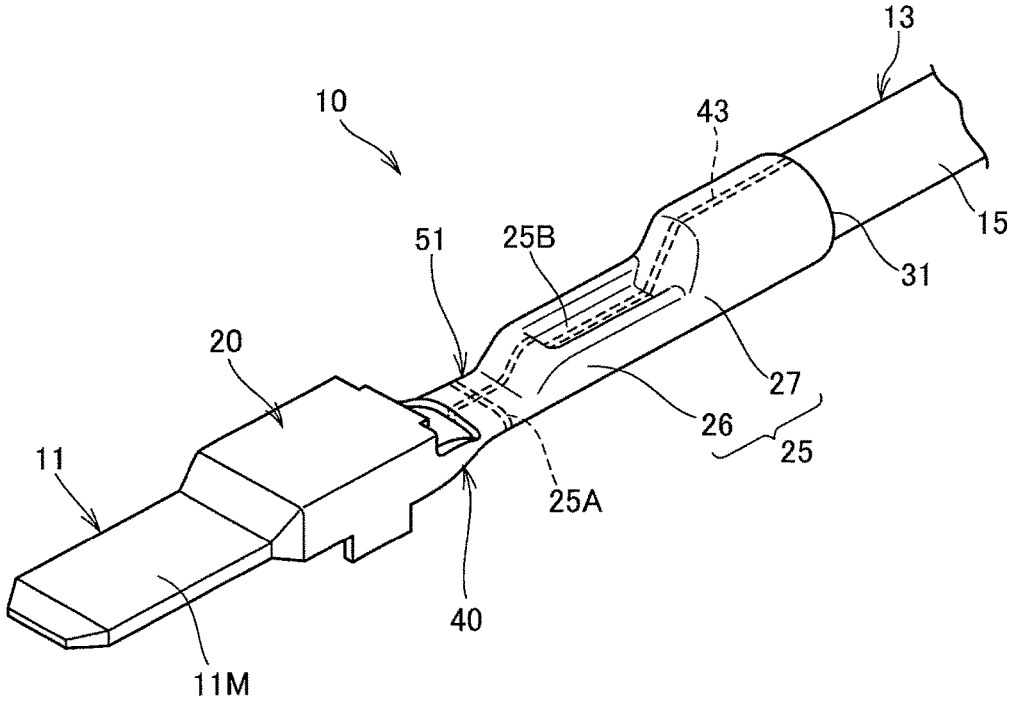
FIG. 10 is a perspective view showing a modification of the terminal.

In the foregoing description, the present invention is applied to the electrical wire connecting structure 10 to which the electrical wire 13 is crimp-connected and the method of manufacturing the same. However, the present invention is not limited to the embodiments described above. For example, in the foregoing description, the box portion 20 of the terminal 11 has a female type terminal. However, as shown in FIG. 10, the box portion 20 may be designed to have a male type terminal 20M (male type box). The metal material constituting the core wire portion 14 may be copper-based material, and metal material having electrical conductivity which can be put to practical use as an electrical wire may be broadly applied.

DESCRIPTION OF REFERENCE NUMERAL

10 electrical wire connecting structure
11 terminal (tube terminal)
13 electrical wire (cover electrical wire, terminal cover exfoliated electrical wire)
14 core wire portion (conductor portion)
15 insulating cover portion (electrical wire cover, cover portion)
15*a* cover tip portion
20 box portion
25 tube-shaped portion
31 electrical wire insertion port (opening portion)
35 conductor crimping portion
36 cover crimping portion
51 closed portion
52 first cylinder portion
53 second diameter-increasing portion (step portion)
54 second cylinder portion
55 third diameter-increasing portion (step portion)
56 third cylinder portion
57 fourth diameter-increasing portion (step portion)
58 fourth cylinder portion
101 crimper
103 anvil

The invention claimed is:

1. A method of manufacturing an electrical wire connecting structure in which a terminal having a tube-shaped portion and a conductor portion of a covered electrical wire are crimped at the tube-shaped portion, and the tube-shaped portion has a conductor crimping portion corresponding to the conductor portion, and a cover crimping portion corresponding to a cover portion of the covered electrical wire, comprising:

forming said terminal having a tube-shaped portion by welding end faces of a terminal forming piece to each other to form the tube-shaped portion, and closing an end portion side opposite to an electrical wire insertion port of the tube-shaped portion, wherein said terminal is a closed cylindrical body that is closed from the end portion side opposite to the electrical wire insertion port except for the electrical wire insertion port, and wherein the tube-shaped portion has an inner diameter of 1.5 to 2.0 mm;

inserting, into the electrical wire insertion port of the tube-shaped portion, the covered electrical wire, wherein an area of the conductor portion in a cross-section vertical to a longitudinal direction of the covered electrical wire ranges from 0.72 to 1.37 $mm^2$;

crimping a welded portion of the conductor crimping portion in one direction; and applying a same pressure to a whole periphery of the cover portion to compress the cover crimping portion, wherein the conductor crimping portion has a crimping mark on which the welded portion is crimped in said one direction, and which is concaved into the conductor portion from the welded portion, wherein the cover crimping portion has uniform elastic repulsive force over the whole periphery of the cover portion upon applying said same pressure to said whole periphery of the cover portion, wherein the tube-shaped portion is a stepped tube having plural tube aperture diameters, and wherein each of the plural aperture diameters corresponds to a thickness of a cover portion of the covered electrical wire.

2. The method of manufacturing the electrical wire connecting structure according to claim 1, wherein the step of closing the end portion side opposite to the electrical wire insertion port of the tube-shaped portion comprises closing by welding.

3. The method of manufacturing the electrical wire connecting structure according to claim 1, comprising forming the closed cylindrical body by press working and laser welding.

4. The method of manufacturing the electrical wire connecting structure according to claim 1, wherein the tube-shaped portion has a larger tube aperture diameter as approaching to the electrical wire insertion port.

5. The method of manufacturing the electrical wire connecting structure according to claim 1, wherein the conductor portion has a compressibility of 75%±5%.

6. A method of manufacturing an electrical wire connecting structure in which a terminal having a tube-shaped portion and a conductor portion of a covered electrical wire are crimped at the tube-shaped portion, and the tube-shaped portion has a conductor crimping portion corresponding to the conductor portion, and a cover crimping portion corresponding to a cover portion of the covered electrical wire, comprising:

forming said terminal having a tube-shaped portion by welding end faces of a terminal forming piece to each other to form the tube-shaped portion, and closing an end portion side opposite to an electrical wire insertion port of the tube-shaped portion, wherein said terminal is a closed cylindrical body that is closed from the end portion side opposite to the electrical wire insertion port except for the electrical wire insertion port, and wherein the tube-shaped portion has an inner diameter of 2.2 to 3.0 mm;

inserting, into the electrical wire insertion port of the tube-shaped portion, the covered electrical wire, wherein an area of the conductor portion in a cross-section vertical to a longitudinal direction of the covered electrical wire ranges from 1.22 to 2.65 $mm^2$;

crimping a welded portion of the conductor crimping portion in one direction; and applying a same pressure to a whole periphery of the cover portion to compress the cover crimping portion, wherein the conductor crimping portion has a crimping mark on which the welded portion is crimped in said one direction, and which is concaved into the conductor portion from the welded portion, wherein the cover crimping portion has uniform elastic repulsive force over the whole periphery of the cover portion upon applying said same pressure to said whole periphery of the cover portion, wherein the tube-shaped portion is a stepped tube having plural tube aperture diameters, and wherein each of the plural aperture diameters corresponds to a thickness of a cover portion of the covered electrical wire.

7. The method of manufacturing the electrical wire connecting structure according to claim 6, wherein the step of closing the end portion side opposite to the electrical wire insertion port of the tube-shaped portion comprises closing by welding.

8. The method of manufacturing the electrical wire connecting structure according to claim 6, comprising forming the closed cylindrical body by press working and laser welding.

9. The method of manufacturing the electrical wire connecting structure according to claim 6, wherein the tube-shaped portion has a larger tube aperture diameter as approaching to the electrical wire insertion port.

10. The method of manufacturing the electrical wire connecting structure according to claim 6, wherein the conductor portion has a compressibility of 75%±5%.

* * * * *